US006296388B1

(12) United States Patent
Galomb et al.

(10) Patent No.: US 6,296,388 B1
(45) **Date of Patent: *Oct. 2, 2001**

(54) FLEXIBLE POUR-SPOUT CLOSURE FOR FLEXIBLE PACKAGE

(75) Inventors: David E. Galomb, Allentown; David K. Suto, Paoli, both of PA (US)

(73) Assignee: Fres-co System USA, Inc., Telford, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/595,826

(22) Filed: Jun. 16, 2000

Related U.S. Application Data

(63) Continuation-in-part of application No. 09/547,408, filed on Apr. 12, 2000, which is a continuation-in-part of application No. 09/294,155, filed on Apr. 19, 1999, now Pat. No. 6,139,187.

(51) Int. Cl.[7] ..... B65D 33/16

(52) U.S. Cl. ..... 383/63; 383/34; 383/35; 383/65; 383/81; 383/120; 383/906; 222/478

(58) Field of Search ..... 383/33, 34, 35, 383/63, 65, 78, 81, 93, 95, 120, 203, 204, 210, 211, 906; 222/107, 478, 465.1, 541.1, 541.5; 150/120, 126

(56) References Cited

U.S. PATENT DOCUMENTS

| | | | | |
|---|---|---|---|---|
| D. 350,696 | | 9/1994 | Naslund . | |
| 811,487 | * | 1/1906 | Davidson | 383/63 X |
| 1,467,009 | | 9/1923 | Peterson . | |

(List continued on next page.)

FOREIGN PATENT DOCUMENTS

| | | | |
|---|---|---|---|
| 42 13 397 A1 | 10/1993 | (DE) . | |
| 1008068 | 4/1963 | (GB) . | |
| 0252402 | 10/1989 | (JP) | 383/34 |

(List continued on next page.)

OTHER PUBLICATIONS

"Champ Insulated Propac II", packaging including ice bag and fastener (photocopy of the product's label and photograph of the fastener part of the product) of Carolon Company of Rural Hal, N.C. No date.

"Clip–it" fastener of Weland M. AB, a Swedish Corporation (two photographs of the fastener). No date.

*Primary Examiner*—Jes F. Pascua
(74) *Attorney, Agent, or Firm*—Caesar, Rivise, Bernstein, Cohen & Pokotilow, Ltd.

(57) ABSTRACT

A pour-spout closure for use on a gusseted flexible package is provided, the package having an interior for holding some material and formed of a flexible material and including first and second panels connected to each other by respective side gussets. Each of the panels and gussets has an upper end portion, at least a portion of which conjoin to form an openable pour-through mouth for the package. When the pour-through mouth is opened, the material within the interior of the package can be poured out. The pour-spout closure is arranged for opening and re-closing the package's pour-through mouth and comprises first and second, elongated closure sections which are coupled together. The first closure section includes a first cut-away portion, and is arranged to be located, e.g, secured, on the first panel with the first cut-away portion disposed over at least a portion of the pour-through mouth. The second closure section includes a second cut-away portion, and is arranged to be located, e.g., secured, on the second panel with the second cut-away portion disposed over at least a portion of the pour-through mouth. The first and second closure sections are arranged to be moved with respect to each other, e.g., pivoted about an interconnecting hinge, into a confronting releasably secured relationship, whereupon portions of the first and second panels and the side gussets are contiguous with the pour-through mouth are positioned adjacent one another to seal said package to prevent the ingress of air into the package. The first and second closure sections are also arranged to be moved, e.g., pivoted about the hinge, into a non-confronting relationship, whereupon the pour-through spout is opened so that the material within the package can be poured therethrough.

20 Claims, 17 Drawing Sheets

U.S. PATENT DOCUMENTS

| | | | | |
|---|---|---|---|---|
| 2,093,974 | | 9/1937 | Farmer . | |
| 2,093,979 | | 9/1937 | Farmer . | |
| 2,188,039 | | 1/1940 | Farmer | 383/906 X |
| 2,260,192 | | 10/1941 | Orr . | |
| 2,369,716 | | 2/1945 | Coghill . | |
| 2,390,822 | * | 12/1945 | Wren | 383/203 X |
| 2,622,986 | | 12/1952 | Snyder et al. . | |
| 2,815,150 | | 12/1957 | Herzig . | |
| 3,085,738 | | 4/1963 | Bok . | |
| 3,200,415 | | 8/1965 | Breece, Jr. . | |
| 3,346,883 | * | 10/1967 | Ersek | 383/63 X |
| 3,353,741 | | 11/1967 | Kamins et al. . | |
| 3,363,827 | | 1/1968 | Renner et al. . | |
| 3,462,068 | | 8/1969 | Suominen | 383/34 X |
| 3,471,871 | | 10/1969 | Nociti et al. . | |
| 3,806,984 | | 4/1974 | Hilsabeck . | |
| 3,815,810 | | 6/1974 | Wellman . | |
| 4,027,819 | | 6/1977 | Herrera-Gutierrez . | |
| 4,309,782 | | 1/1982 | Paulin . | |
| 4,343,053 | | 8/1982 | O'Connor . | |
| 4,576,285 | | 3/1986 | Goglio . | |
| 4,576,316 | * | 3/1986 | Foster | 383/103 X |
| 4,705,174 | | 11/1987 | Goglio . | |
| 4,753,489 | | 6/1988 | Mochizuki . | |
| 4,913,561 | | 4/1990 | Beer . | |
| 4,948,266 | | 8/1990 | Bencic | 383/34 |
| 4,988,216 | | 1/1991 | Lyman . | |
| 4,996,727 | | 3/1991 | Wyatt . | |
| 5,037,138 | | 8/1991 | McClintock et al. . | |
| 5,059,036 | | 10/1991 | Richison et al. . | |
| 5,147,444 | | 9/1992 | Richison et al. . | |
| 5,692,837 | | 12/1997 | Beer . | |
| 5,709,479 | * | 1/1998 | Bell | 383/67 X |
| 5,738,444 | | 4/1998 | Lantz et al. . | |
| 6,116,780 | | 9/2000 | Young et al. . | |
| 6,139,187 | * | 10/2000 | Galomb et al. | 383/35 X |
| 6,164,821 | * | 12/2000 | Randall | 150/120 X |

FOREIGN PATENT DOCUMENTS

| | | |
|---|---|---|
| 6127557 | 10/1989 | (JP) . |
| 4164701 | 6/1992 | (JP) . |
| WO 93/14985 | 8/1993 | (WO) . |

* cited by examiner

FIG. 11
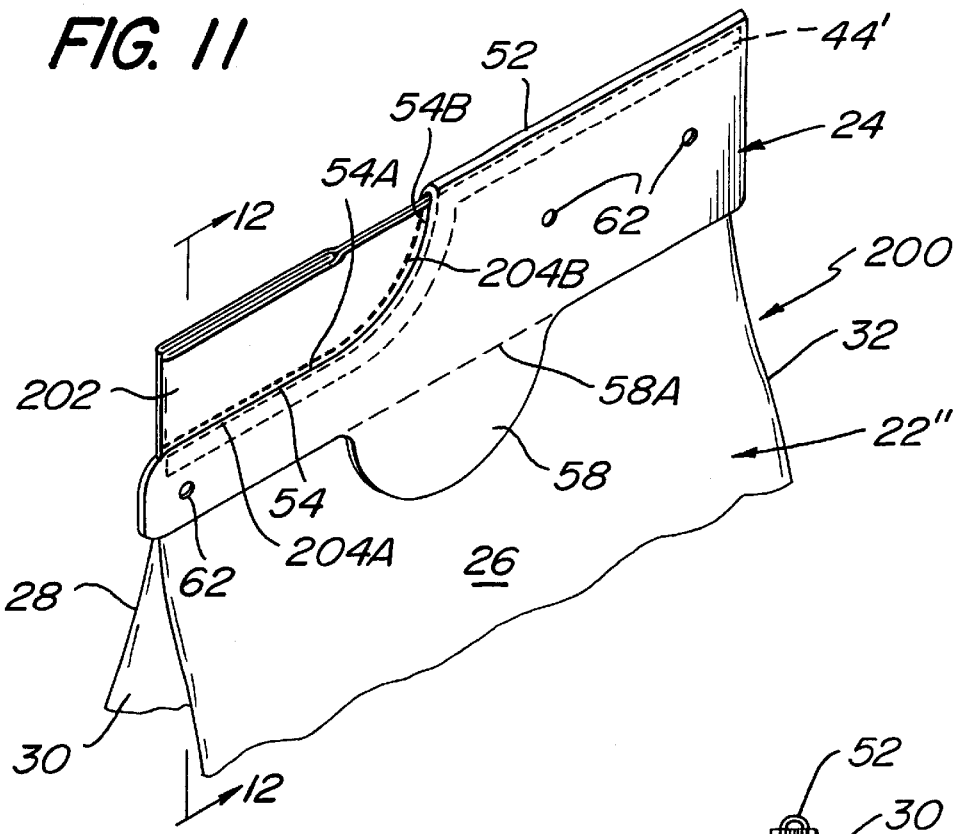
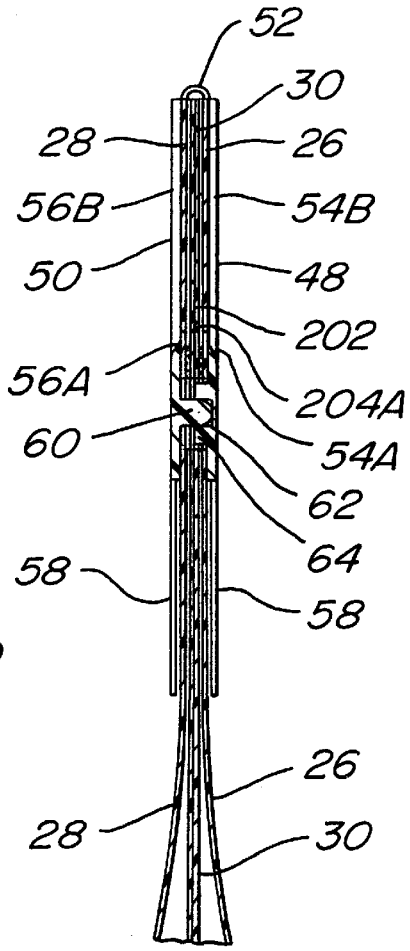
FIG. 12

FIG. 23
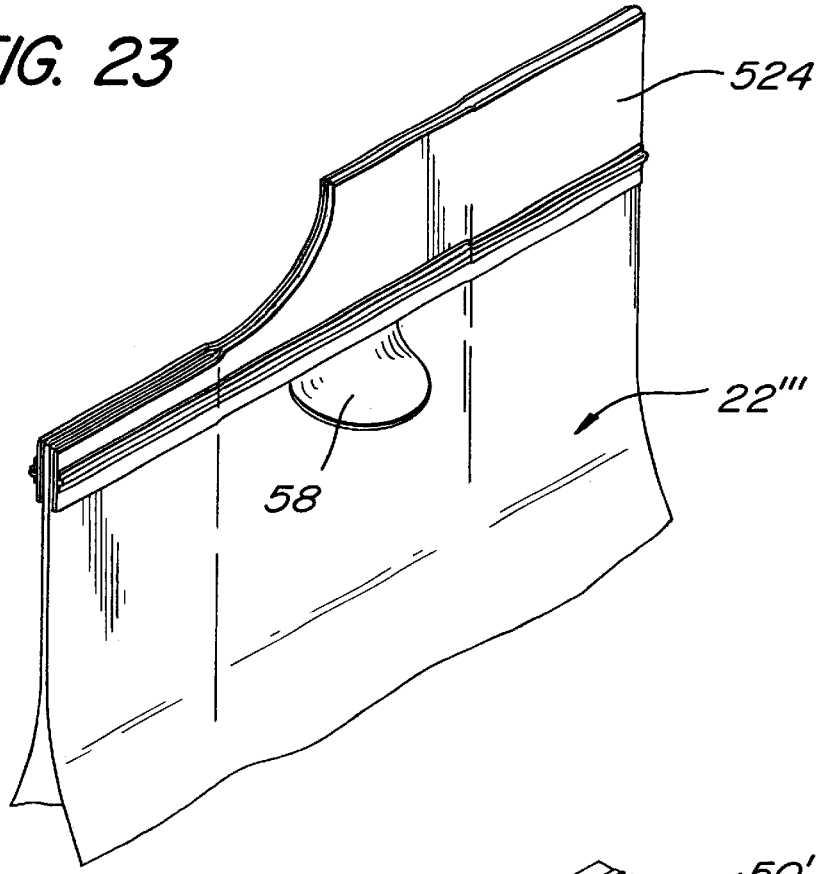
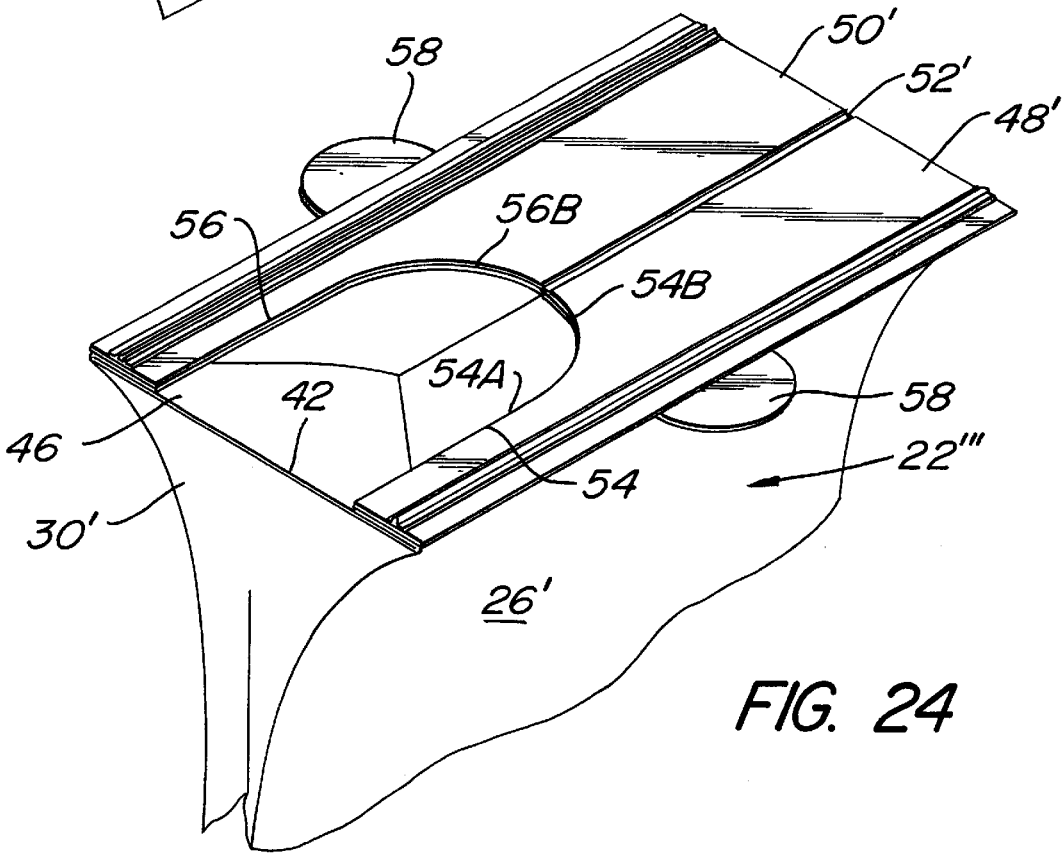
FIG. 24

FIG. 30
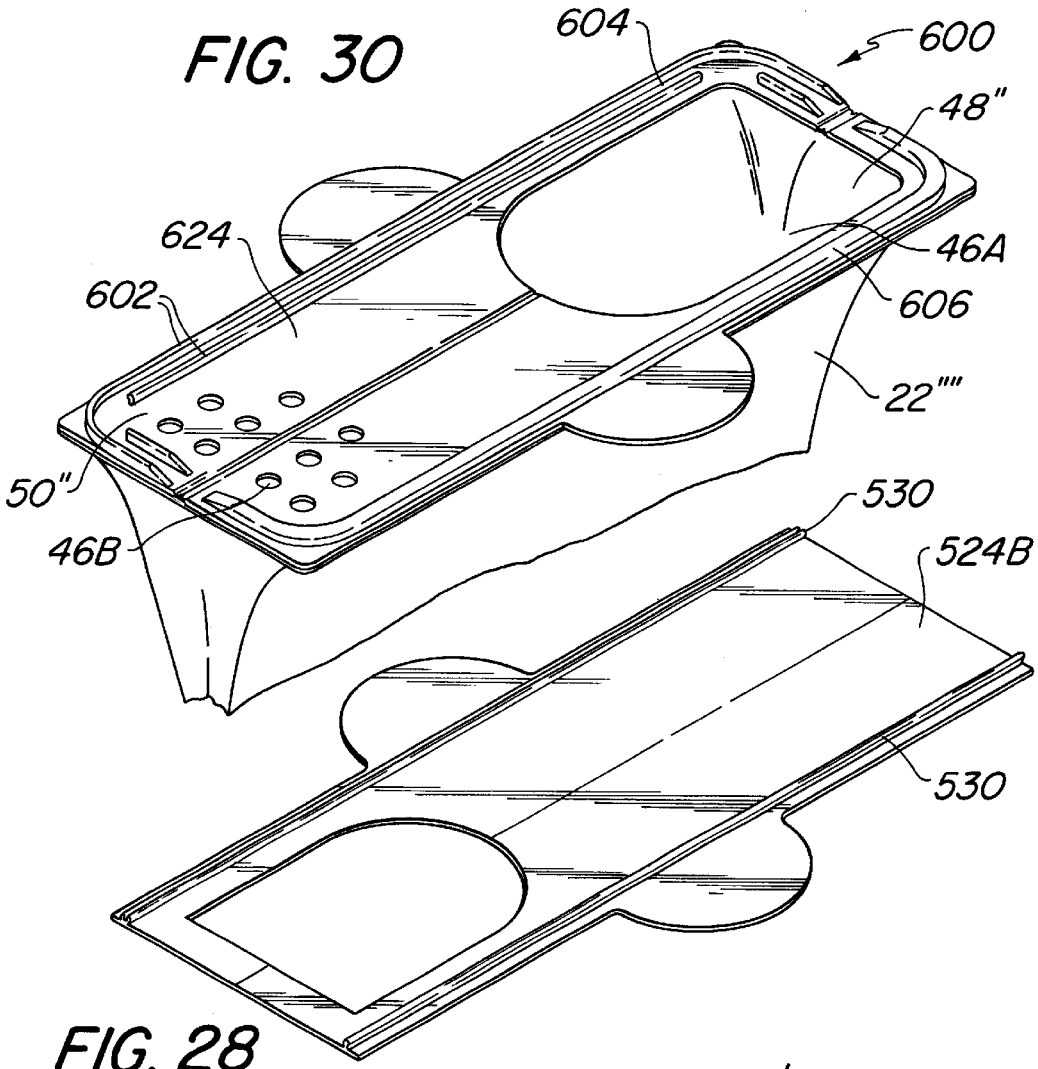
FIG. 28
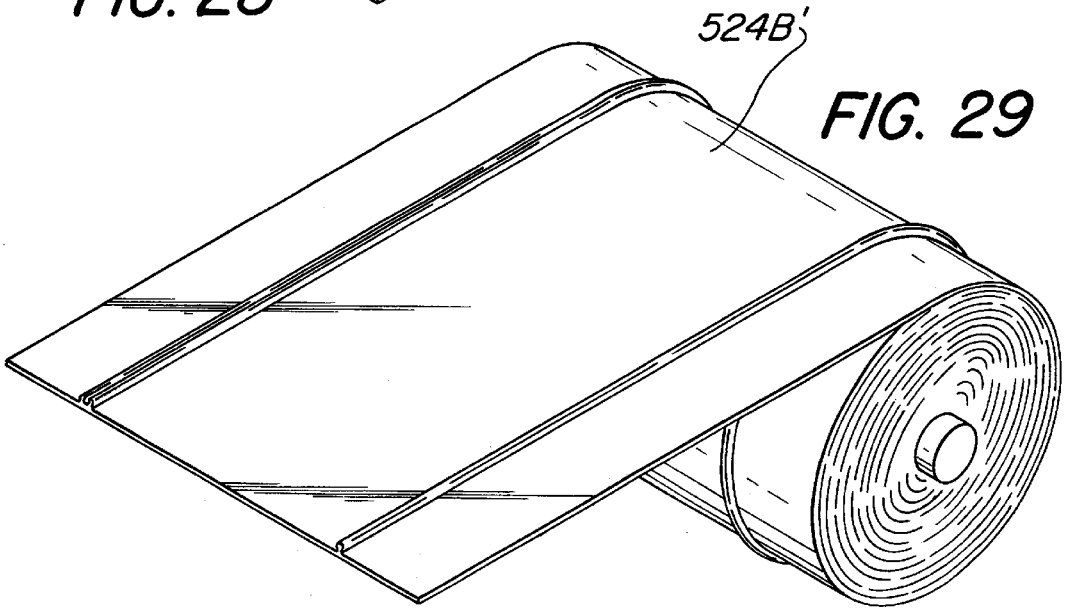
FIG. 29

FLEXIBLE POUR-SPOUT CLOSURE FOR FLEXIBLE PACKAGE

CROSS-REFERENCES TO RELATED APPLICATIONS

This is a continuation-in-part application of U.S. Ser. No. 09/547,408, filed Apr. 12, 2000 which is a continuation-in-part application of U.S. Ser. No. 09/294,155, filed Apr. 19, 1999, now U.S. Pat. No. 6,139,187.

BACKGROUND OF THE INVENTION

This invention relates generally to flexible packages, and, more particularly, to flexible packages for holding products, such as foods, under vacuum therein, and which, once opened, are arranged to readily pour the contents therefrom via a pour-spout, and then to be readily re-closed to keep the contents fresh, until the package is again reopened to pour more of the contents therefrom.

Various types of flexible packages for holding particulate materials, e.g., ground or whole bean coffee, chemicals, etc., under vacuum therein have been disclosed in the patent literature and are commercially available today. Examples of such packages are found in the following U.S. Pat. No. : 4,576,285 (Goglio), U.S. Pat. No 4,705,174 (Goglio), and U.S. Pat. No 4,913,561 (Beer).

The major advantages of flexible packaging, as compared to relatively rigid packaging, e.g., cartons, are that until the flexible package is filled it takes up very little volume, and after it is emptied of its contents, it readily collapses, thereby reducing its volume to approximately that of the unfilled package. The former characteristic is a significant advantage insofar as storage is concerned, while the latter characteristic is a significant advantage from the standpoint of being disposable.

One common type of flexible package for holding goods under vacuum until the package is opened is the so-called "gusseted" package or bag. Typically, such a package is formed from a web of flexible stock material, e.g., polyethylene, polyester, polypropylene, metal foil, and combinations thereof in single or multiple plies, into a tubular body, having a face panel, a back panel, and a pair of gusseted sides. Each gusseted side is formed by a pair of gusset sections and a central fold edge interposed between a pair of outer fold edges. The lower end of the bag is commonly permanently sealed, e.g., heat sealed, along a line extending transversely across the width of the bag close to its bottom edge. The top of the bag is commonly sealed transversely across the entire width of the bag in a number of ways to maintain the contents under vacuum until the bag is opened. Such action is frequently accomplished via a readily openable mouth, which, when opened, provides access to the contents of the bag. For example, in one prior art package, the top seal is made peelable by modifying the sealant layer with a peelable coating or incompatible additive. Thus, when the seal is peeled apart, the unsealed portions form an open mouth through which the contents of is the package may be removed. Another approach to providing an opening or mouth for a flexible package is that of the heretofore identified U.S. Pat. No. 4,705,174 (Goglio). That package includes a peel strip applied to the inner surface of the package below the top edges. The strip provides an air-tight interfacial seal which can be readily peeled apart to provide access to the interior of the package. Another approach to providing an opening or mouth for a flexible package is to score the upper flap of the package by laser or mechanical means through a tear initiation resistant layer(s) of the package structure. In this way, the package can be opened by tearing away the scored area to form the package's mouth. Gusseted bags, particularly those for foods, frequently make use of a plastic coated wire tie to serve as closure for the bag. In particular, the wire tie is designed to close the mouth of the bag after it has been initially opened so that the re-closed bag will keep its contents fresh. Whether or not such wire-tie closures effectively provide a positive means of re-closing a gusseted package is open to debate. Moreover, the effectiveness of such closures is frequently dependent upon the manner in which the wire tie is used. Thus, there is a perception in some quarters of the consuming public that a wire-tie package cannot be re-closed securely enough to maintain product freshness over an extended period of time. Therefore, such packages have not been fully accepted as being truly reclosable.

In U.S. Pat. No. 5,692,837 (Beer), which is assigned to the same assignee as this invention and whose disclosure is incorporated by reference herein, there is disclosed a gusseted flexible package having a integrated snap closure for re-closing and resealing the package after it has been initially opened. In particular, that package has an interior for initially holding some product, e.g., whole coffee bean or ground coffee, under vacuum, and which includes a mouth portion arranged to be peeled open to provide access to the contents of the package. The package is formed of a flexible material and includes a front panel, a rear panel, and a pair of opposed side gussets. The panels and gussets each include a top portion, which, between them, define the package's mouth. A peelable closure is provided within the mouth. A snap closure is provided above the peelable closure. The package is arranged to be sealed under vacuum, with the peelable closure maintaining the vacuum within the package until it is peeled open. The snap closure comprises a pair of snap strip members secured to respective portions of the front and rear panel. The snap strip portions are arranged to be releasably snap fit together with portions of the closure extending through opening in the side gussets, so that the snap strip portions can be opened and reclosed after the peelable closure has been peeled open in order to provide repeated access to the interior of the package, while minimizing the ingress of air into the package when it is closed.

In copending U.S. patent application Ser. No. 09/231,337, filed on Jan. 13, 1999, entitled Snap Closure For Flexible Packages And Flexible Packages Including The Same, which is assigned to the same assignee as this invention and whose disclosure is incorporated by reference herein, there are disclosed closures for gusseted flexible packages and gusseted flexible packages including such closures. The package is formed of a flexible material and includes a front panel, a rear panel, and a pair of opposed side gussets. The panels and gussets each include a top portion, which between them define the package's mouth. The package's mouth is initially sealed but arranged to be opened, e.g., peeled apart. The snap closure enables the resealing of the mouth of the package and is made up of a pair of elongated elements, one of which includes a tongue extending along the length of it. The other element includes an undercut groove extending along the length of it. The elements are arranged to be pressed together, whereupon the tongue of the one element enters the groove of the other element with portions of the panels and side gussets tightly interposed therebetween. The closure elements may be a part of the package or a separate component for use therewith. In any case, when the closure is utilized, it recloses the mouth of the package to preclude or minimize the ingress of air into the package.

Other prior art closures for packages are found in U.S. Pat. No. : 4,988,216 (Lyman), U.S. Pat. No 5,037,138 (McClintock et al.), 5,059,036 (Richison et al.), U.S. Pat. No 5,147,272 (Richison et al.), U.S. Pat. No 5,738,444 (Lantz et al.), D350,696 (aslund), and in Japanese Application 6127557 (May 1994), and United Kingdom Patent 1,008, 068 (October 1965). In addition, Weland M. AB, a Swedish Corporation, sells a "CLIP-it" fastener for bags or packages and Carolon Company of Rural Hall, NC. sells a packaging system, including an ice bag and fastener for sealing the ice bag, under the trademark "CHAMP INSULATED PROPAC II." The "CLIP-it fastener" comprises a clip having one portion including a pair of ridges and another portion which includes a tapered groove into which the pair of ridges is directed to sandwich the walls of the bag being closed. In order to hold the clip in place, the portion of the clip including the groove includes a movable snap type fastener which is arranged to releasably secure to an ear or tab portion on the other part of the clip, i.e., the clip including the pair of ridges. The package system of Carolon Company includes a bag and a fastener for the bag. The fastener is arranged to be used to close the bag and includes a pair of sections which are hingedly secured together by a living hinge along the top marginal edge of the fastener. One of the sections includes a C-shaped recess and the other section includes a circular projection mounted on an upstanding flange and which is arranged to be received to be snap fit within the C-shaped recess to hold the walls of the bag therebetween.

While the aforementioned prior art may suitable for their intended purposes, a need still exists for closures for use on gusseted packages which, when opened, establish a pour spout to facilitate the pouring of all or some of the contents from the package and which when re-closed keep the contents of the package fresh, and for gusseted packages including such closures.

OBJECTS OF THE INVENTION

Accordingly, it is a general object of this invention to provide a pour-spout closure for use with gusseted flexible packages and a gusseted flexible package with a pour-spout closure which addresses the needs of the prior art.

It is a further object of this invention to provide a pour-spout closure for use on a gusseted flexible package and a gusseted flexible package having a pour-spout closure that is openable so that when the closure is opened it provides a spout at the package's mouth through which all or a portion of the contents of the package can be readily poured, and when the closure is closed it shuts the mouth to keep the remaining contents of the package fresh.

It is a further object of this invention to provide a pour-spout closure for use on a gusseted package and a gusseted flexible package including a pour-spout closure which is simple in construction.

It is a further object of this invention to provide a pour-spout closure for use on a gusseted package and a gusseted flexible package including a pour-spout closure which is easy to use.

It is still a further object of this invention to provide a pour spout-closure for use on a gusseted package and a gusseted flexible package including a pour spout closure which is produced from a laminated film to facilitate automated production methods.

It is still a further object of this invention to provide a pour spout-closure for use on a gusseted package and a gusseted flexible package including a pour spout closure which is produced from a laminated film that facilitates easy customization of the pour-spout closure to fit a variety of sizes of gusseted packages.

It is still a further object of this invention to provide a pour spout-closure for use on a gusseted package and a gusseted flexible package including a pour spout closure where the pour spout closure has means to seal substantially around the entire periphery of the pour spout closure to reduce moisture and atmospheric penetration and aid in retaining granular products within the package and reduces the likelihood that fine particles will migrate out of the package and become trapped in the center fold and/or crevices of the pour spout closure.

It is still a further object of this invention to provide a pour spout-closure for use on a gusseted package and a gusseted flexible package including a pour spout closure where the pour spout closure provides more than one pouring orifices to allow product contained in the package to be removed in a controlled manner by selecting an appropriate pouring orifice or series of pouring orifices.

It is still a further object of this invention to provide a pour spout-closure for use on a gusseted package and a gusseted flexible package including a pour spout closure where the tog opening of the pour spout extends substantially the length and width of the package to allow maximum access to the contents of the package.

SUMMARY OF THE INVENTION

These and other objects of the instant invention are achieved by providing a pour-spout closure and a flexible, gusseted package including a pour-spout closure. The package has an interior for holding some material, e.g., whole bean coffee, ground coffee, etc., and is formed of a flexible material. The package includes first and second panels connected to each other by respective side gussets. Each of the panels and gussets has an upper end portion, at least a portion of which conjoin to form an openable pour-through mouth for the package. When the pour-through mouth is opened, the material within the interior of the package can be poured out.

The pour-spout closure is arranged for opening and re-losing the package's pour-through mouth and comprises first and second, elongated closure sections which are coupled together. The first closure section includes a first cut-away portion, and is arranged to be located, e.g., secured, on the first panel with the first cut-away portion disposed over at least a portion of the pour-through mouth. The second closure section also includes a second cutaway portion, and is arranged to be located, e.g., secured, on the second panel with the second cut-away portion disposed over at least a portion of the pour-through mouth.

The first and second closure sections are arranged to be moved with respect to each other, e.g., pivoted about an interconnecting hinge, into a confronting releasably secured relationship, whereupon portions of the first and second panels and the side gussets are contiguous with the pour-through mouth are positioned adjacent one another to seal said package to prevent the ingress of air into the package. The first and second closure sections are also arranged to be moved, e.g., pivoted about the hinge, into a non-confronting relationship, whereupon the pour-through spout is opened so that the material within the package can be poured there-through.

DESCRIPTION OF THE DRAWING

FIG. 11 is an isometric view of the top portion of still another embodiment of a flexible gusseted package including a pour-spout closure constructed in accordance with this invention;

FIG. 12 is an enlarged sectional view taken along line 12—12 of FIG. 11;

FIG. 23 is an isometric view of the top portion of the package of FIG. 16 shown in an initial position during installation of a pour spout.;

FIG. 24 is an isometric view of the top portion of the package of FIG. 16, shown in an open position, or an intermediate position during installation of the pour spout;

FIG. 28 A is an isometric view of the top portion of still another embodiment of a flexible gusseted package including a pour spout closure constructed in accordance with this invention constructed from a laminated film or other highly flexible material.

FIG. 29 is a roll of raw material for use on the pour spout closure of FIG. 28, prior to forming the pour spout closure.

FIG. 30 is an isometric view of the top portion of yet another embodiment of a flexible gusseted package including a pour-spout closure constructed in accordance with this invention and shown in an open position.

DETAILED DESCRIPTION OF THE PREFERRED EMBODIMENT

Figure 1:
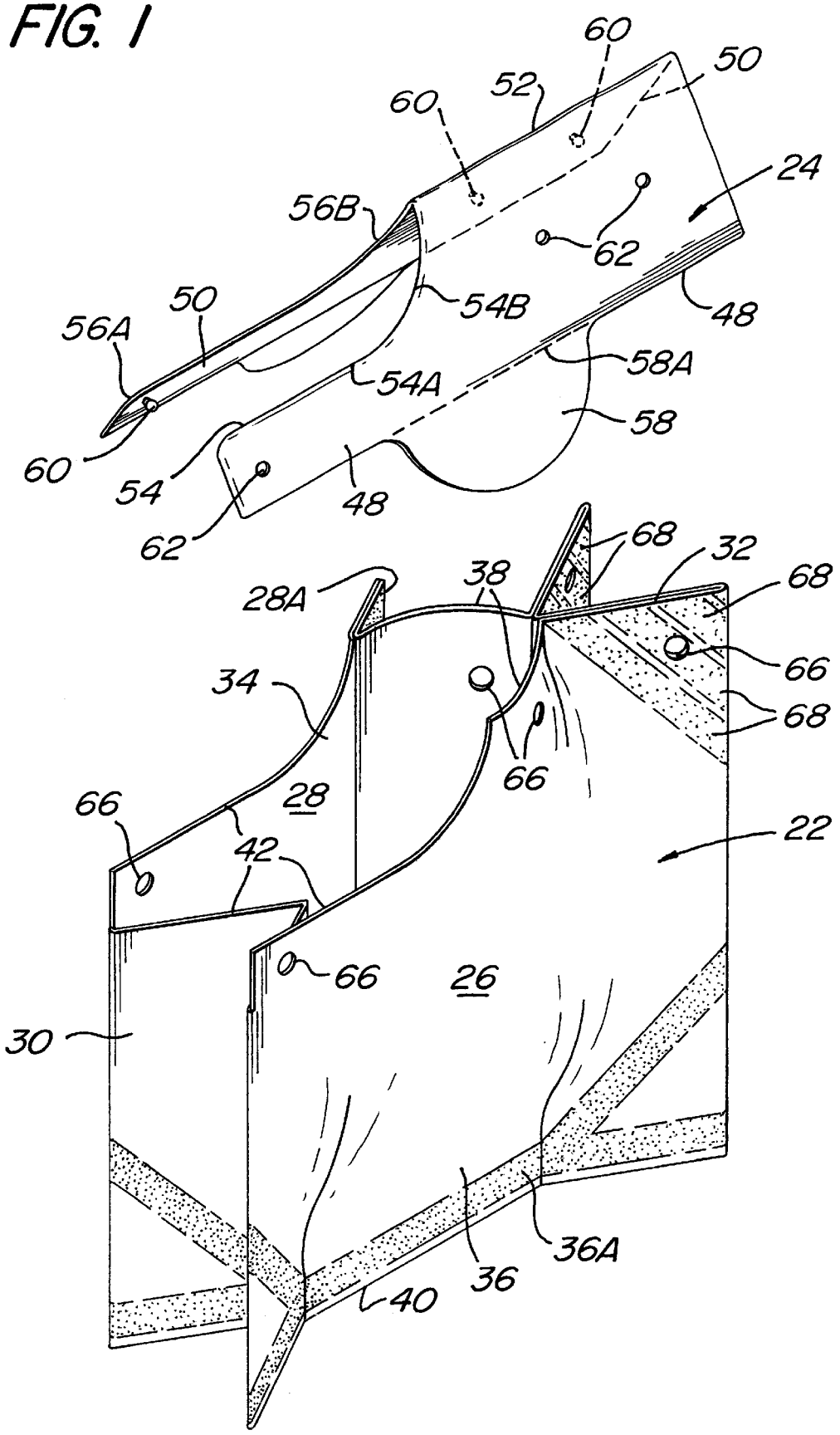
FIG. 1 is an exploded isometric view of one embodiment of a flexible gusseted package including a pour-spout closure constructed in accordance with this invention.
Figure 2:
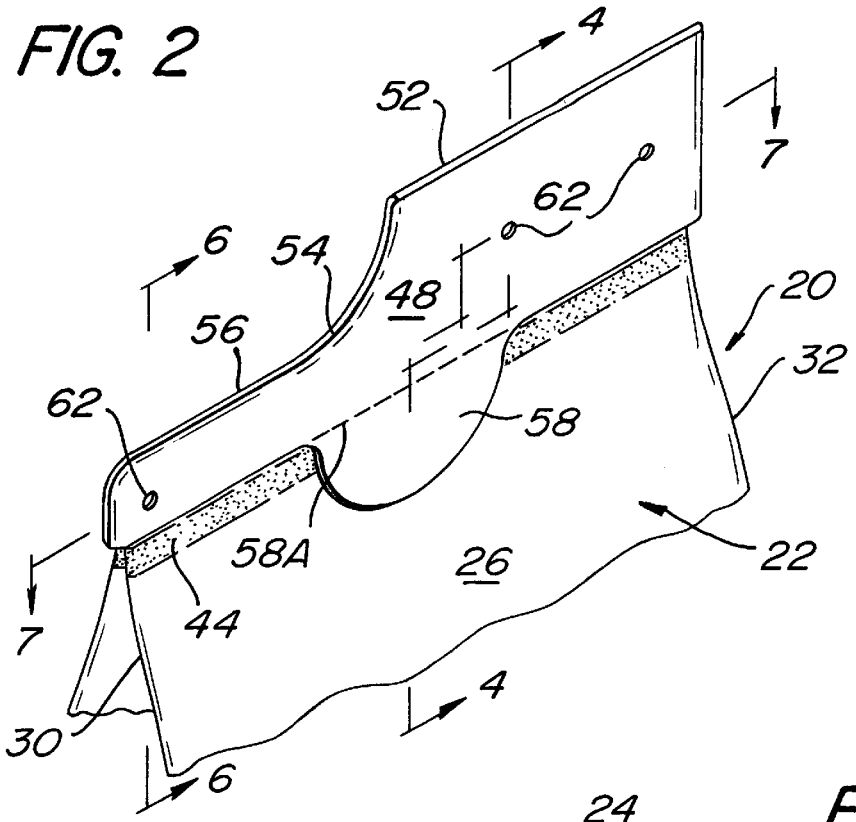
FIG. 2 is an isometric view of the top portion of the package of FIG. 1 shown in the state prior to being opened to pour contents of the package through the pour closure.
Figure 3:
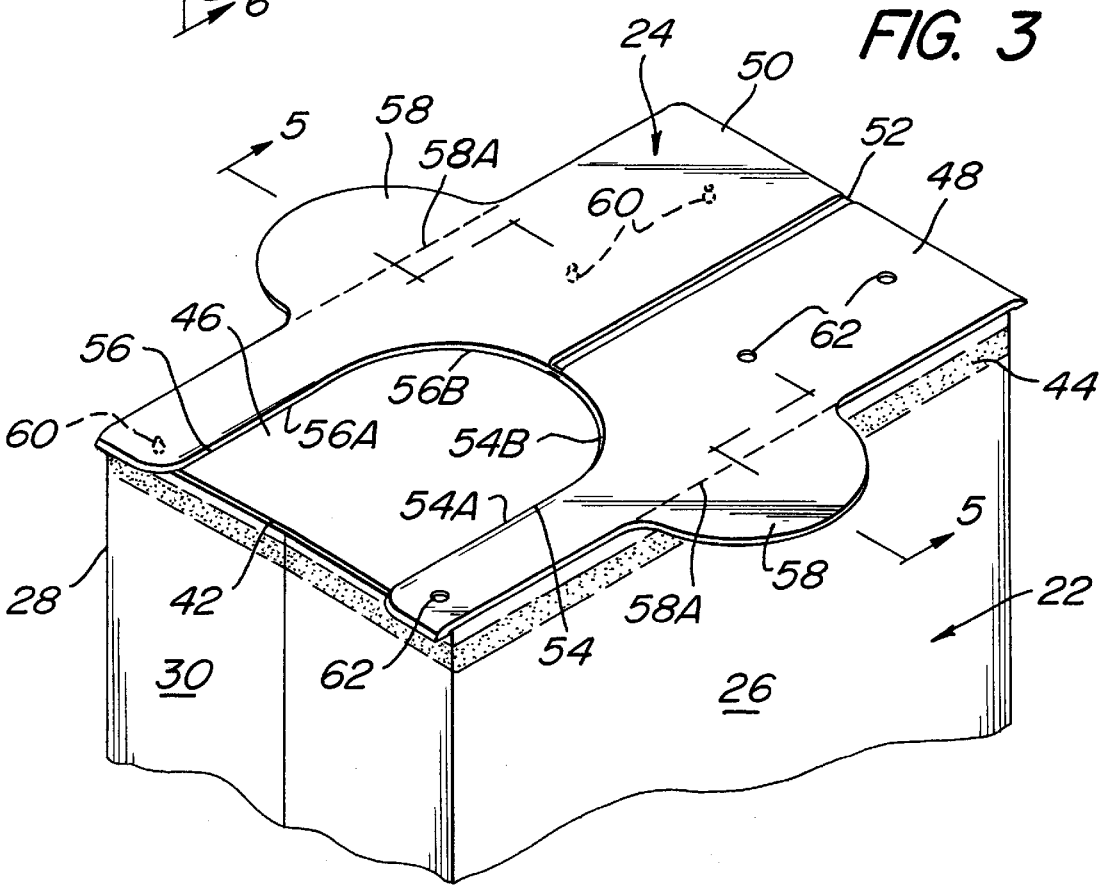
FIG. 3 is a an isometric view like that of FIG. 2 but showing the package in the state wherein the pour-spout closure is opened to pour the contents of the package therethrough.
Figure 5:
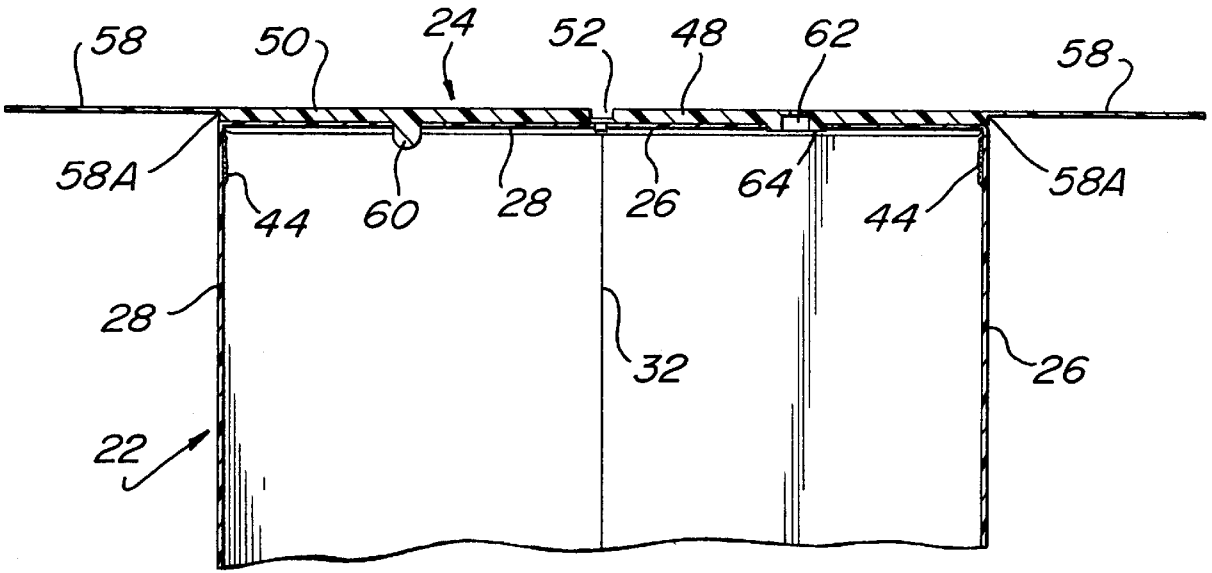
FIG. 5 is an enlarged sectional view taken along line 5—5 of FIG. 3.
Figure 4:
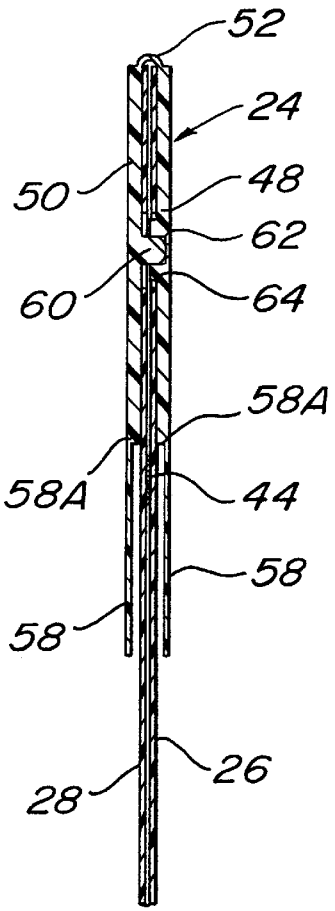
FIG. 4 is an enlarged sectional view taken along line 4—4 of FIG. 2.
Figure 6:
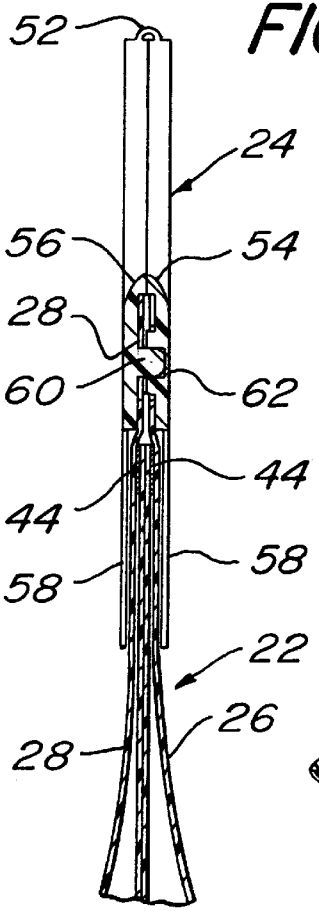
FIG. 6 is an enlarged sectional view taken along line 6—6 of FIG. 2.
Figure 7:
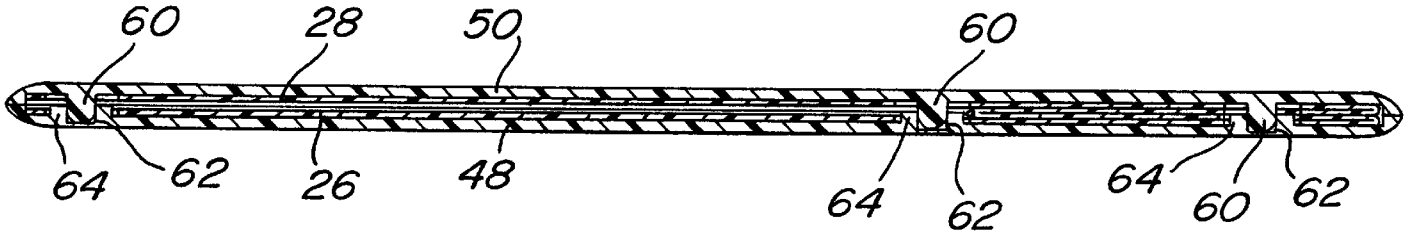
FIG. 7 is an enlarged sectional view taken along line 7—7 of FIG. 2.

Referring to FIGS. 1 through 3, there is shown at 20 a flexible package constructed in accordance with this invention. The package 20 basically comprises a gusseted bag 22 and a pour-spout-forming, resealable closure 24. The bag 22 is arranged to hold any material, e.g., coffee beans, ground coffee, chemicals, etc., for dispensing therefrom. The bag or package 22 is best seen in FIG. 1. To that end, as can be seen, the bag 22 is formed of a web of any suitable, flexible material and basically comprises a front wall or panel 26, a rear wall or panel 28, a pair of identical gusseted sides 30 and 32, a top end portion 34, and a bottom end portion 36. The top end portion 34 of the package terminates in a top marginal edge 38. In a similar manner, the bottom end portion 36 terminates in a bottom marginal edge 40. The package is formed as a tube and includes a longitudinally extending seam or fin 28A extending along the back panel 28. The bottom of the package is sealed by conventional heat seal lines 36A.

An openable pour-though mouth 42 is provided in the top portion of the package at one of the side gussets, e.g., gusset 30. The details of the pour-through mouth will be described later. Suffice it for now to state that the mouth 42 is cut away from the material making up the front panel 26, side gusset 30, and rear panel 28 at the top edge thereof. The mouth 42 is arranged to be held closed by the pour-spout closure 24, as will be described later, to prevent the ingress of air into the bag 22 through the mouth 42 after the package has initially been opened (prior to that time the material within the interior of the package is isolated from the ambient atmosphere by a peelable seal line 44, to be described later). The pour-through mouth 42 is also arranged to be opened by operating the pour-spout closure 24 to form a pouring spout 46, as shown in FIG. 3, whereupon the contents of the bag 22 can be poured out through the spout. The pour-spout closure 24 can be operated to reseal the pour-through mouth 42 after use to maintain the freshness of any material still remaining within the package.

If desired, a one-way venting valve (not shown) may be included in any suitable portion of the package to enable gases which may be produced by the material(s), e.g., coffee, contained within the sealed package to vent to the ambient air without air gaining ingress to the package's interior.

The front panel 26, rear panel 28, and the two gusseted sides 30 and 32 of the package are all integral portions of a single sheet or web of the flexible material, of single or multiple ply or layers, which has been folded and seamed along fin 28A to form a tubular body. The materials forming the package may be plastic, paper, fabric, etc., or combinations of one or more of such materials. One particularly useful flexible material for the bag 22 is a laminated web of flexible packaging material commercially available from Fres-Co System USA, Inc., of Telford Pa., the assignee of this invention. That material may include an inner layer in the form of an easy open (peelable) sealant layer to form a peelable seal adjacent the mouth of the bag. That peelable seal is preferably a strip or line 44 (FIG. 3) extending across the entire width of the bag, including the front and rear panels and side gussets at the top portion thereof, e.g., immediately below the pour spout closure 24, to initially seal the contents of the package within the interior of the bag. In accordance with the preferred embodiment of the invention shown in FIG. 1, the peelable seal 44 is arranged to be peeled open by the operation of the pour-spout closure 24, as will be described later.

As can be seen clearly in FIGS. 1 and 2, the pour-spout closure 24 is located on the top end portion 34 of the package. The closure 24 basically includes two closure members or strip sections 48 and 50 which are interconnected by a hinge 52, e.g., a reduced thickness living hinge. Each of the strips is an elongate member formed of any suitable somewhat stiff material or combination of materials, e.g., high or low density polyethylene or polypropylene, laminate cardboard, etc. In a preferred embodiment, the closure is molded as an integral or one-piece member of plastic. Each strip is arranged to be fixedly secured, e.g., welded or permanently adhesively secured, to the outer surface of the top portion of a respective one of the panels 26 and 28 of the bag 22 and across the full width of the panel.

The closure's strip sections 48 and 50 are arranged to be pivoted with respect to each other about the hinge 52 from a confronting, closed position shown in FIG. 2, whereupon the pour-spout closure 24 holds the mouth 42 of the package 20 closed, to a non-confronting, coplanar or open position shown in FIG. 3, whereupon the pour-spout closure 24 forms a generally U-shaped pouring spout 46 at the bag's mouth 42 and through which the bag's contents may be poured. To that end, the strip sections 48 and 50 include cut-away portions 54 and 56, respectively, which overlie the pour-through mouth 42 of the bag 22 and which form the pouring-spout 46. Each strip section extends across the width of a respective one of the package's panels 26 and 28. In particular, the strip section 48 extends across and is secured on the outer surface at the top portion of the front panel 26. The strip section 50 extends across and is secured on the outer surface at the top portion of the rear panel 28. The cut-away portion 54 of the strip section 48 includes a linear portion 54A and an arcuate portion 54B. The cut-way portion 56 of the strip section 50 includes a linear portion 56A and an arcuate portion 56B. The arcuate portions 56A and 56B conjoin with each other such that when the closure 24 is open, i.e., is in its flat, coplanar configuration like that shown in FIG. 3, the linear and arcuate cut away portions of two strip sections form a generally U-shaped pour-spout 46. This U-shaped pour spout extends about most of the periphery of the bag's mouth, except for the portion of the mouth at the gusset 30, to hold the mouth open.

The package 20 is arranged to be initially hermetically sealed closed along the seal line 44, after it has been filled and vacuumized. As mentioned earlier, the seal line 44 is openable, e.g., peelable, and may be formed in any conventional manner. For example, it may be formed by the appropriate heat sealing of the abutting easy-open sealant layer portions forming the inner surface of the bag 22. Alternatively, a peelable seal line 44 can be formed by the use of peelable sealing strips like that disclosed in the aforementioned Goglio patents, whose disclosures are incorporated by reference herein.

The peelable seal line 44 may be located at any suitable location with respect to the closure. In the embodiment shown, it is located just slightly below it. In any case, the peelable seal line 44 extends across the width of the bag 22 and seals the inner surfaces of the abutting front and rear panels to each other between the inner fold lines of the gussets, respectively, while sealing the outer marginal portions of the front panel 26 to the portions of the contiguous gusseted sides and also sealing the outer marginal portions of the rear panel 28 to the portions of the contiguous gusseted sides, as is conventional. Thus, the peelable seal line 44 serves to isolate the contents of the package from the ambient atmosphere once the package is initially filled and sealed.

The pour-through mouth 42 of the bag 22 is arranged to be readily opened by use of the closure 24 so that all or a portion of the contents of the package can be poured from the closure's spout 46. In particular, the package's mouth can be readily opened by merely grasping and pulling on the strip sections 48 and 50 to pivot them from the confronting closed position shown in FIG. 2 to the open position shown in FIG. 3. To expedite this action, each strip section includes a respective arcuately shaped tab 58 extending downward from the bottom edge of each strip section. A weakened fold line 58A extends along each tab. The tabs 58 are not secured to the immediately adjacent bag panel so that the user can readily grasp each tab between the thumb and index finger of each hand to pivot the strip sections upward and outward along the fold lines 28A from their confronting closed position of FIG. 2 to their coplanar open position of FIG. 3. It should be noted that the pull tabs 58 need not be made part of the closure 24 itself, such as in the embodiment of FIG. 1 and the embodiment of FIGS. 11 and 13 and of FIGS. 16–27 (to be described later), but may be made part of the bag 22, as will be described with reference to the embodiment shown in FIG. 8.

In any case, pulling the tabs apart causes the associated closure strips of the pour spout closure to move from their closed or confronting relationship to their open or non-confronting coplanar relationship, to thereby pull the bag's front and rear panels from engagement with each other and with the interposed gussets. This action, when first accomplished, causes the peelable seal line 44 to open, to thereby open the bag's pour-through mouth 42 and to form the pour spout 46.

As can be seen clearly in FIG. 3, when the closure 24 is in its opened position it essentially forms a generally planar top wall for the package 20 with a pour-spout 46 located at one of the sides thereof. Thus, the material within the interior of the package can be readily poured out of the package through the mouth 42 and contiguous spout 46. In order to facilitate the formation of a generally planar top wall of the package when the spout closure is opened, the corner of the bag at each outside fold of the side gusset 32 (the gusset opposite the side of package's mouth) is heat sealed in a triangular area by plural heat seals 68. Thus, when the spout closure 24 is opened those heat sealed gusset areas can readily fold down to overlie contiguous areas of that gusset, so that the assumption of the spout closure into its open, coplanar state is not impeded.

In order to hold the two closure strips 48 and 50 in their closed confronting orientation like shown in FIG. 2, the closure 24 includes means for releasably securing them together. Such means may take any suitable form. For example, in the exemplary embodiment shown in FIG. 1, the releasably securable means comprise plural respective interlocking or snap-fitting posts 60 projecting from the inner surface of the strip section 50 and corresponding associated sockets 62 in the strip section 48. As best seen in FIGS. 4–7, each post 60 comprises a rodlike member projecting upward from the inner surface of the strip section 50. Each socket 62 comprises a two millimeter diameter bore projecting inward into the body (thickness) of the strip section 48 from a short height boss 64 on the inner surface of that strip section. The entrance to the bore is of a larger diameter than the portion of the bore extending to the outside surface of the strip section and is slightly smaller in diameter than the diameter of the post 60 to releasably secure, e.g., snap-fit, the post therein. The posts and sockets are located on corresponding portions of the strip sections 50 and 48, respectively, so that each post is received within a corresponding socket when the strip sections are in their confronting relationship. In the embodiment shown in FIG. 1 three such posts and sockets are used.

In order to enable the posts and sockets to releasably snap-fit together, respective holes 66 are provided in the front panel 26 , rear panel 28 and side gussets of the package aligned with the posts and sockets. Thus, when the two strip sections 48 and 50 of the closure 24 are pivoted to the closed or confronting relationship, the posts projecting from the section 50 extend through the aligned holes 66 in the rear panel 28, side gussets and front panel 26 of the package and into their corresponding sockets 62 in the strip section 48. This action tightly sandwiches the top portion of the front panel 26, rear panel 28 and side gussets of the package between the two strip sections, while the cut away portions of those sections overlie the now closed pour-through mouth of the package. Accordingly, the package 20 is effectively closed to ensure that air does not enter into it to degrade the freshness of its contents.

Figure 8:
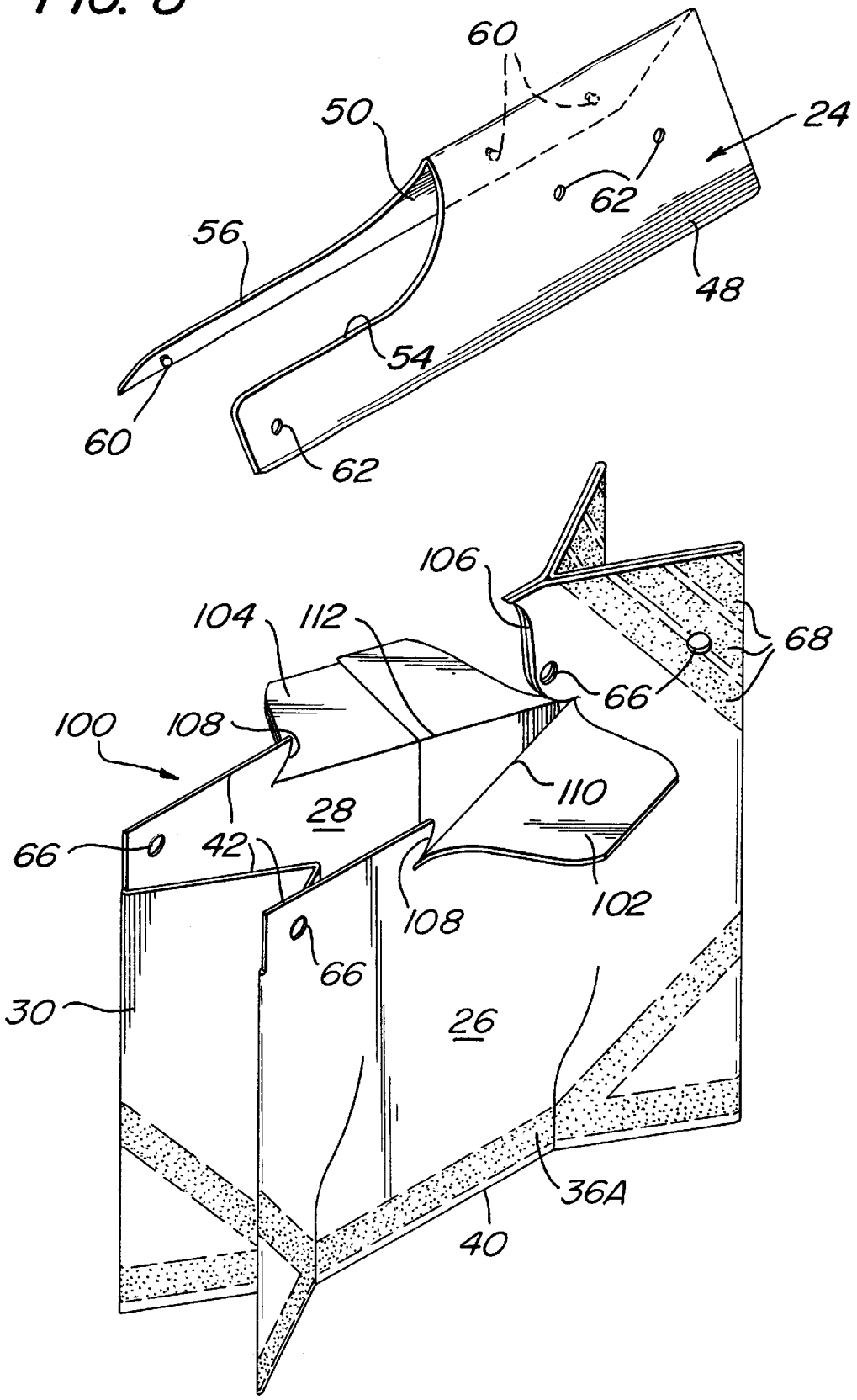
FIG. 8 is an exploded isometric view of another embodiment of a flexible gusseted package including a pour-spout closure constructed in accordance with this invention.
Figure 10:
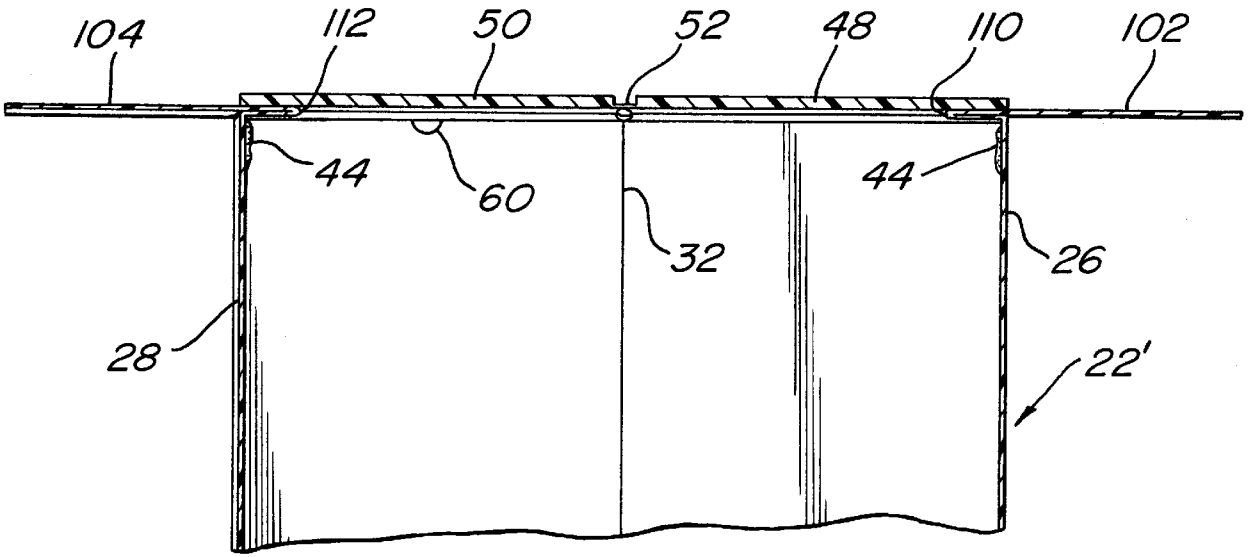
FIG. 10 is a view similar to FIG. 5 but of the embodiment of the package of FIG. 8.
Figure 9:
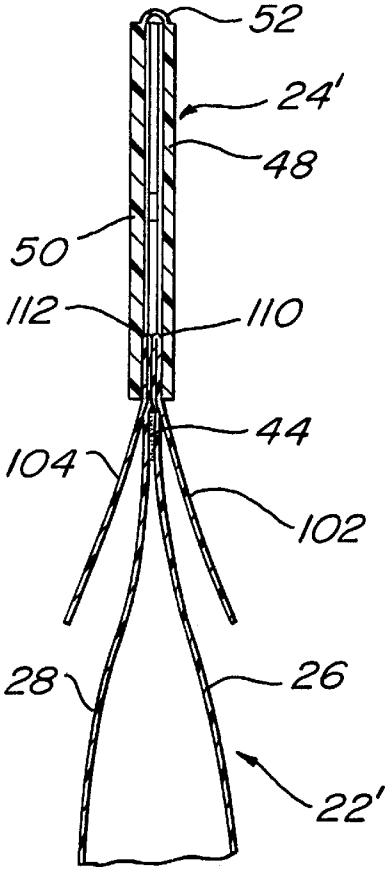
FIG. 9 is a view similar to FIG. 4 but of the embodiment of the package of FIG. 8.

In FIG. 8, there is shown an alternative embodiment of a package 100 of the subject invention. The package 100 is virtually identical to the package 20, except that the pour spout closure of the package 100, now referred to by the reference number 24', doesn't include the heretofore described pull tabs 58. Instead, the pull tabs for the package (to be described later) are a part of the flexible bag, now referred to by the reference number 22'. In the interest of brevity, the common structural details of the packages 20 and 100 will be given the same reference numbers and their construction and operation will not be reiterated. Only the different features will be described in detail. Thus, as can be seen in FIG. 8, the upper end portions of the front and rear panels 26 and 28 of the bag 22' include respective pull tabs portions 102 and 104. The tabs are die cut along lines 106 and 108 from the top edge of the front and rear panel contiguous with the mouth 42 and are folded over the contiguous portion of the panel from which they are cut. The tabs are located so that their respective fold lines 110 and 112 are under the strip sections 48 and 50, respectively, of the closure 24' as shown in FIG. 9. The strip sections 48 and 50 are secured in place on the panels 26 and 28 so that the tab portions 102 and 104 extend generally parallel to the panels, but can be lifted therefrom to enable the user to grasp each tab between his/her thumb and index finger to open the spoutclosure in the same manner as described heretofore. The marginal edges of the cut away portions 54 and 56 form the U-shaped pour spout 46 for the package 100 when the pour spout closure is in its open orientation, like shown in FIG. 10.

In FIG. 11, there is shown another alternative embodiment of a package 200 of the subject invention. The package 200 is virtually identical to the package 20, except that the mouth of the bag has not been pre-formed. Instead the bag, now designated by the reference number 22", includes a removable portion 202 which is arranged to be removed from the bag to form the mouth. Moreover, the peelable seal line, now designated by the reference number 44,' is of a slightly different shape and is located along the top edge of the package under the spout closure 24. In the interest of brevity, the common structural details of the packages 20 and 200 will be given the same reference numbers and their construction and operation will not be reiterated. Only the different features will be described in detail. Thus, as can be seen in FIG. 11, the removable mouth-forming portion 202 of the bag 22" is made up of a portion front panel 26, rear panel 28 and side gusset 30 which is perforated or otherwise weakened along line 204 so that it can be removed, e.g., torn away, to form the mouth 42' for the bag 22." The line 204 includes a linear portion (not shown) extending along the side gusset 30 parallel to the top edge of the bag, a linear portion 204A extending along the front panel 26 from the gusset 30 inward towards the center of the bag, at which point an arcuate portion 204B curves toward the top edge of the bag, and a similar linear portion (not shown)extending along the rear panel from the gusset 30 inward towards the center of the bag, at which point an arcuate portion (not shown) curves toward the top edge of the bag.

The peelable seal line 44' is located along the top edge of the bag and the perforated line 204 and extends parallel thereto for the full width of the bag, including its side gussets 30 and 32. Operation of the package 200 is as follows. To initially open the package, from its closed condition shown in FIG. 11, the removable portion 202 of the package grasped between the thumb and index finger of the user to tear the portion 202 along the perforation line 204. This forms the mouth 42 for the bag, albeit the mouth is still closed by the confronting strip sections 48 and 50. To open the mouth 42 and form the pour spout 46, the pull tabs 58 are grasped as described with reference to the package 20 to cause the two strip sections 48 and 50 to pivot to their open non-confronting coplanar relationship, whereupon the peelable seal line 44' is broken, the mouth 42 of the bag is opened and the pour spout 46 is formed. The contents of the package can then be poured out of the package through the mouth and spout. If it is desired to reclose the package the two strip sections are then pivoted with respect to each other into their confronting relationship so that the posts and sockets engage to tightly sandwich the top portion of the bag 22" therebetween.

Figure 13:
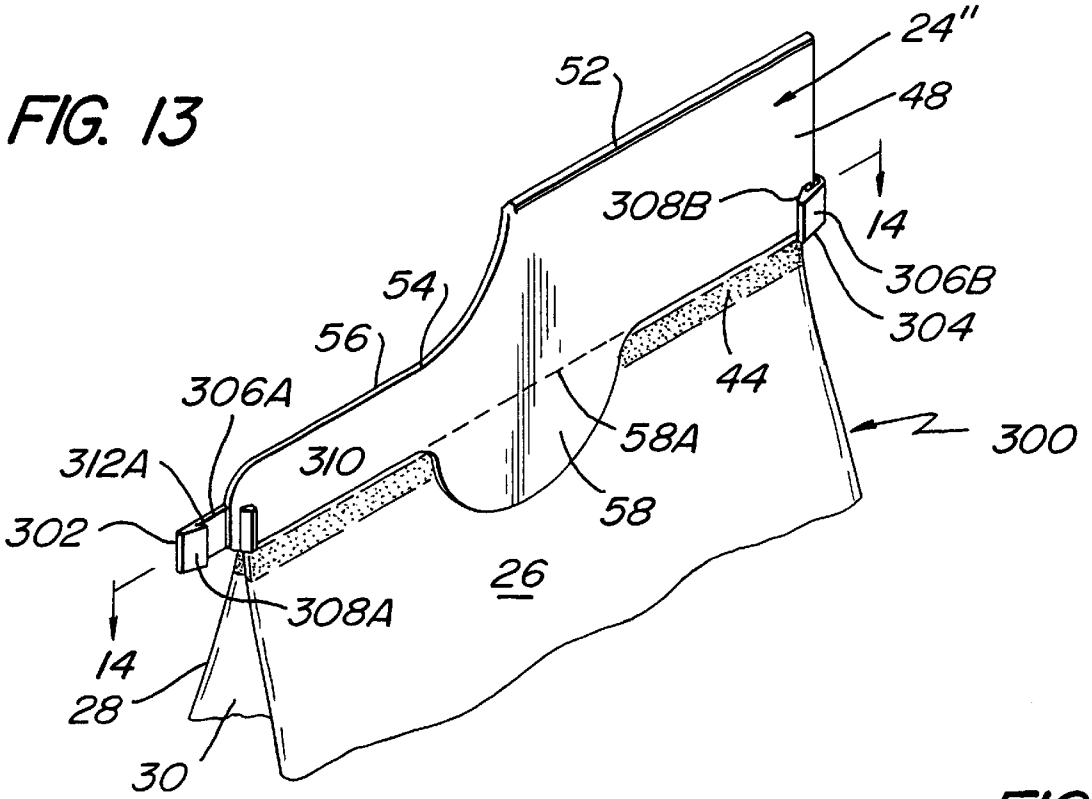
FIG. 13 is an isometric view of the top portion of yet another embodiment of a flexible gusseted package including a pour-spout closure constructed in accordance with this invention.

In FIG. 13, there is shown another alternative embodiment of a package 300 of the subject invention. The package 300 is virtually identical to the package 20, except that the pour-spout closure, now designated by the reference number 24", includes different releasably securable means than the heretofore described posts and sockets to hold the pour-spout closure in its closed state. In the interest of brevity, the common structural details of the packages 20 and 300 will be given the same reference numbers and their construction and operation will not be reiterated. Only the different features will be described in detail. Thus, as can be seen in FIG. 13, the pour spout closure 24" does not include the heretofore identified posts 60 and sockets 62. Instead, the pour spout closure includes two catch assemblies 302 and 304 mounted on respective ends of the pour spout closure. In particular, the catch assembly 302 includes a flexible finger 306A projecting outward from the side edge of the strip section 50 adjacent the spout. The free end of the finger 306A is in the form of a wedge shaped catch or flange 308A. An ear 310A extends outward from the outer surface of the strip section 48 at the corresponding side as the finger 306A. The finger 306A is flexible so that it can be bent to cause an undercut surface 312A of the catch 308A to engage a side surface of the ear 310A to thereby releasably secure the catch 308A to the ear 310A. In a similar manner the catch assembly 304 includes a flexible finger 306B projecting outward from the opposite side edge of the strip section 50. The free end of the finger 306B is in the form of a wedge shaped catch or flange 308B. An ear 310B extends outward from the outer surface of the strip section 48 at the corresponding side as the finger 306B. The finger 306B is flexible so that it can be bent to cause an undercut surface 312B of the catch 308B to engage an undercut surface of the ear 310B to thereby releasably secure the catch 308B to the ear 310B.

Figure 14:
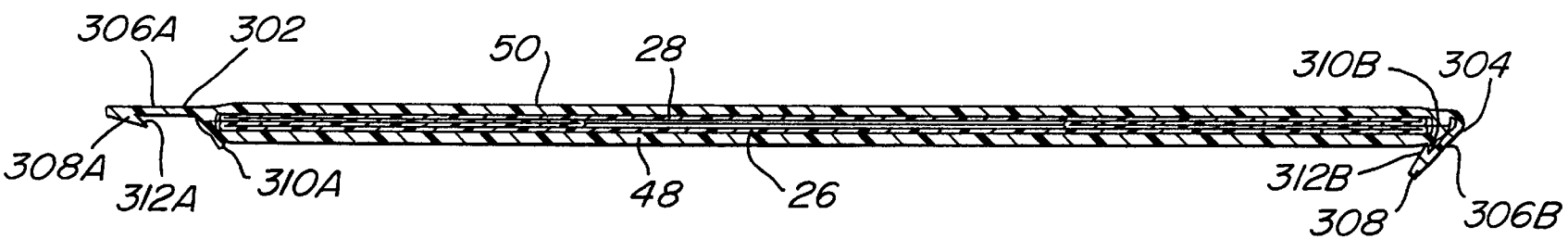
FIG. 14 is an enlarged sectional view taken along line 14—14 of FIG. 13.

When it is desired to close the package two strip sections are pivoted with respect to each other into their confronting relationship, as described earlier, and then the catches 302 and 304 are engaged to tightly sandwich the top portion of the bag therebetween as shown clearly in FIG. 14.

Figure 15:
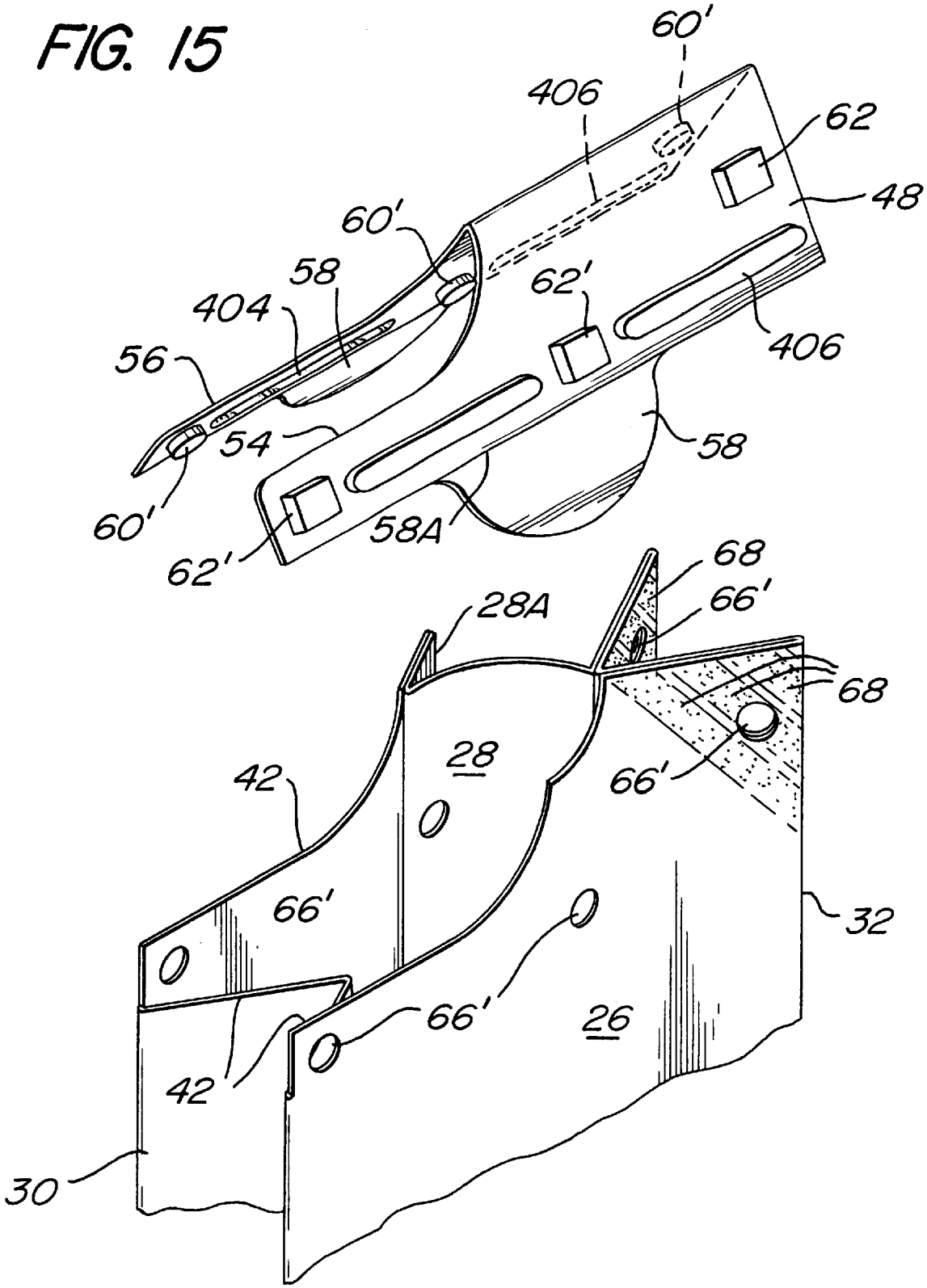
FIG. 15 is an exploded isometric view of still another embodiment of a flexible gusseted package including a pour-spout closure constructed in accordance with this invention;.

In FIG. 15, there is shown another alternative embodiment of a package 400 of the subject invention. The package 400 is virtually identical to the package 20, except that the pour-spout closure, now designated by the reference number 24'" is a thin thermo-formed or vacuum formed, one-piece member which includes different releasably securable means than the heretofore described posts and sockets to hold the pour-spout closure in its closed state. In the interest of brevity, the common structural details of the packages 20 and 400 will be given the same reference numbers and their construction and operation will not be reiterated. Only the different features will be described in detail. Thus, as can be seen in FIG. 15, the pour spout closure 24'" does not include the heretofore identified posts 60 and sockets 62. Instead, the pour spout closure includes three convex hollow circular profile post members 60' projecting outward from the inner surface of the strip section 50 and three hollow square profile convex sockets 62' extending into the inner surface of the strip section 48 for releasably receiving the hollow post members therein when the two strip sections 48 and 50 are brought into their closed confronting relationship. The bag includes slightly larger holes 66' in its panels and gussets to enable the post members 60' to extend therethrough. Since the strip members 48 and 50 are formed of a thin sheet of material, in order to provide some longitudinal rigidity to those strips, they also include plural elongated convex ridges 404 and 406 projecting outward from the outer surface of each of the strip sections.

Figure 16:
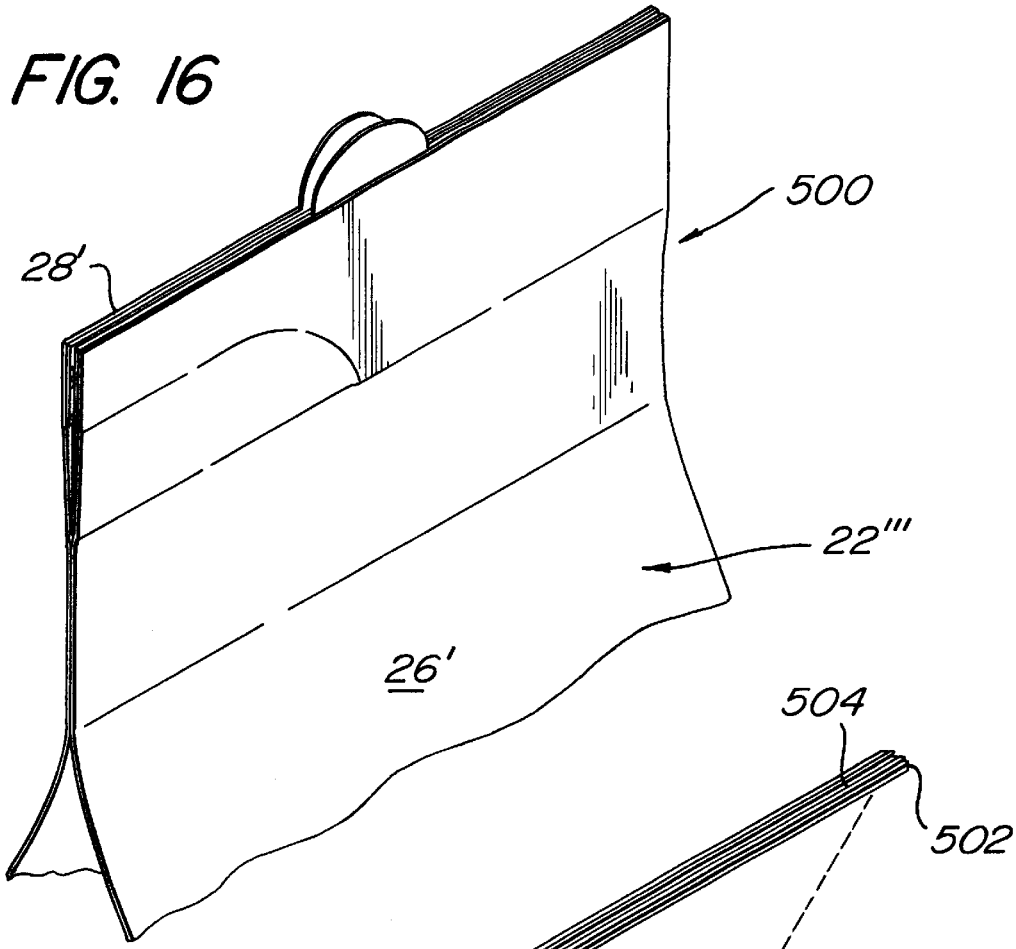
FIG. 16 is an isometric view of the top portion of the package of yet another embodiment of a flexible gusseted package including a pour-spout closure constructed in accordance with this invention and shown in the state prior to being opened to pour contents of the package through the pour closure.

In FIG. 16, there is shown another alternative embodiment of a package 500 of the subject invention. The package 500 is similar to the package 20, except that the pour-spout closure, now designated by the reference number 524, includes different releasably securable means than the heretofore described posts and sockets of the embodiments of FIG. 1, 8 and 11, the catch assembly of the embodiment of FIG. 13, and the posts and sockets of FIG. 15 to hold the pour-spout closure in its closed state. Additionally, the pour spout closure 524 folds in an downward direction when unsealing and opening the flexible package to gain access to the contents of the package, rather than folding the pour spout closure upwardly toward the top of the package as in the prior embodiments. In the prior embodiments, for example, as shown in FIG. 1, in order to enable the posts 60 and sockets 62 to releasably snap-fit together, respective holes 66 are provided in the front panel 26, rear panel 28 and side gussets 30, 32 of the package aligned with the posts 60 and sockets 62. Thus, when the two strip sections 48 and of the closure 24 of the embodiment of FIG. 1 are pivoted to the closed or confronting relationship, the posts 60 projecting from the section 50 extend through the aligned holes 66 in the rear panel 28, side gussets and front panel 26 of the package and into their corresponding sockets 62 in the strip section 48. In the embodiment of FIG. 16, as can be seen in FIGS. 17–27, the closure 524 folds upwardly such that a rib 502 extending along the entire width of closure strip 48' having a groove 504 is adapted to interlock with a second rib 506 extending along the entire width of closure strip 50" having a protruding track 508 thereon. Therefore, no holes corresponding to holes 66 in the embodiment of FIG. 1 are required. This embodiment will now be described in further detail.

Figure 17:
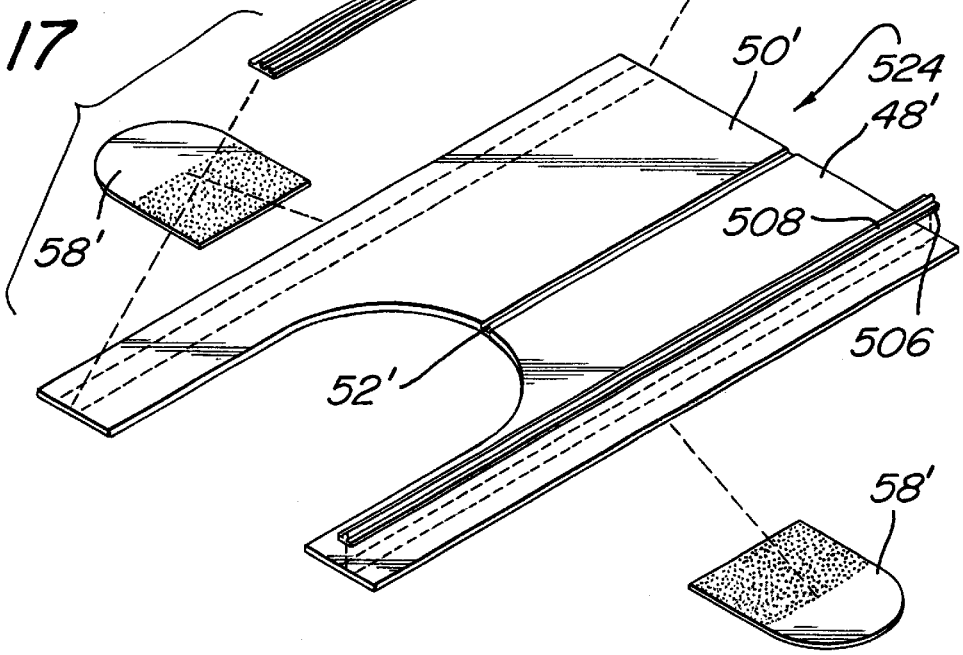
FIG. 17 is an exploded, isometric view of a pour spout closure in accordance with the embodiment of FIG. 16, with the pour spout in an open position.

In the interest of brevity, the common structural details of the packages 20 and 500 will be given the same reference numbers and their construction and operation will not be reiterated. Only substantially different features will be described in detail. Thus, as can be seen in FIG. 17, the pour spout closure 524 does not include the posts 60 and sockets 62 as depicted in FIG. 1. Instead, the pour spout closure includes ribs 502, 506 having a receptacle groove 504 and protruding track 508 mounted on respective ends of the pour spout closure 524. In particular, the ribs 502, 506 are located adjacent the outer edges of the closure 524.

As can be seen in FIG. 17 which depicts an exploded view of the pour spout 524 of the present embodiment, the pour spout 524 here is of similar construction to that of the pour spout 24 as described and shown with respect to the embodiment of FIGS. 1–7. The closure 524 basically includes two closure members or strip sections 48' and 50' which are interconnected by a hinge 52', e.g., a reduced thickness living hinge. Each of the strips 48', 50' is an elongate member formed of any suitable somewhat stiff material or combination of materials, e.g., high or low density polyethylene or polypropylene, laminate cardboard, etc. In an alternate preferred embodiment (FIG. 20), the closure 524 is molded as an integral or onepiece member of plastic. Each strip 48', 50' is arranged to be fixedly secured, e.g., welded or permanently adhesively secured, to the outer surface of the top portion of a respective one of the panels 26', 28' of the bag 22'" and across the full width of the panel.

The closure's strip sections 48' and 50' are arranged to be pivoted with respect to each other about the hinge 52' from a confronting, closed position shown in FIG. 16, whereupon the pour-spout closure 524 holds the mouth 42 of the package 500 closed, to a non-confronting, coplanar or open position shown in FIG. 24, whereupon the pour-spout closure 524 forms a generally U-shaped pouring spout 46 at the bag's mouth 42 and through which the bag's contents may be poured. To that end, the strip sections 48' and 50' include cut-away portions 54 and 56, respectively, which overlie the pour-through mouth 42 of the bag 22''' and which form the pouring-spout 46. Each strip section 48', 50' extends across the width of a respective one of the package's panels 26' and 28'. In particular, the strip section 48' extends across and is secured on the outer surface at the top portion of the front panel 26'. The strip section 50' extends across and is secured on the outer surface at the top portion of the rear panel 28'. The cut-away portion 54 of the strip section 48' includes a linear portion 54A and an arcuate portion 54B. The cut-way portion 56 of the strip section 50' includes a linear portion 56A and an arcuate portion 56B. The arcuate portions 56A and 56B conjoin with each other such that when the closure 524 is open, i.e., is in its flat, coplanar configuration like that shown in FIG. 24, the linear and arcuate cut away portions of two strip sections form a generally U-shaped pour-spout 46. This U-shaped pour spout 46 extends about most of the periphery of the bag's mouth, except for the portion of the mouth at the gusseted side 30', to hold the mouth open.

Figure 18:
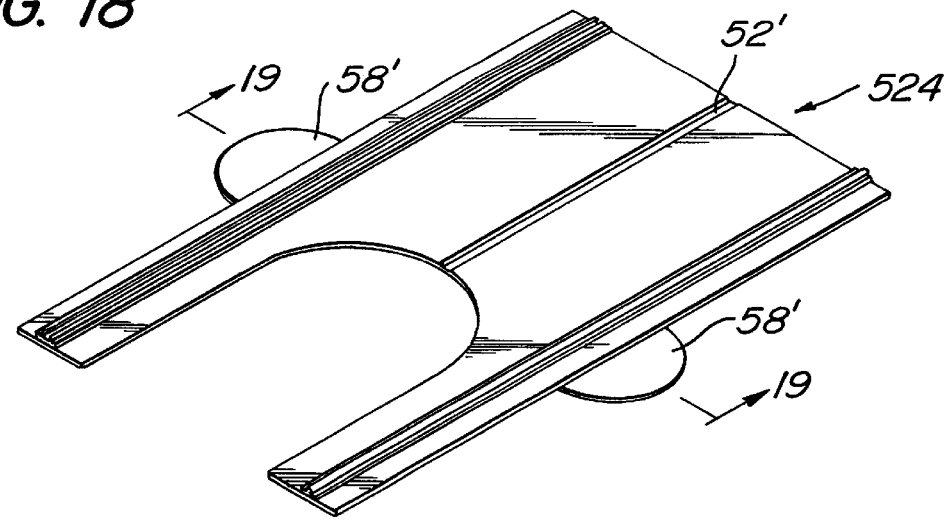
FIG. 18 is an isometric view of the pour spout closure of FIG. 17.
Figure 19:
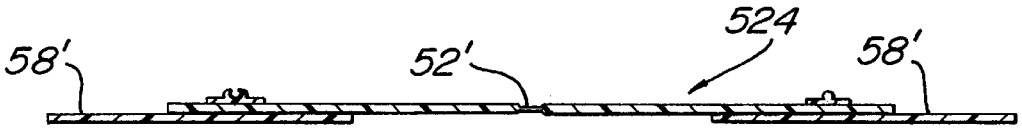
FIG. 19 is an enlarged, cross-sectional side view of the pour spout closure of FIG. 17, taken substantially along line 19—19 of FIG. 18.
Figure 20:
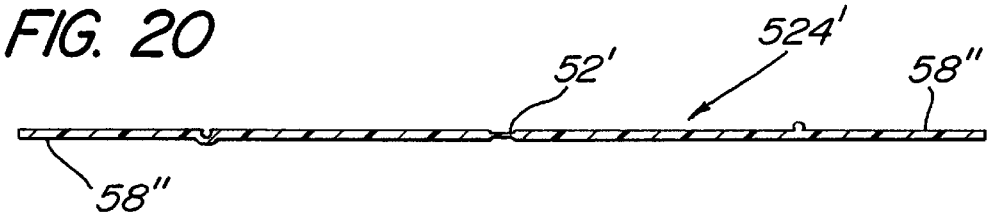
FIG. 20 is an enlarged, cross-sectional view of an alternate pour spout where the pull tabs are integrally formed with the pour spout closure.

FIGS. 17, 18, and 19 also depict pull tabs 58', fabricated from any suitable material, for example, fabricated from the same flexible material of the package. Here, the tabs 58' are depicted as non-integral tabs that are welded or otherwise permanently adhesively secured to the closure spout 524. Likewise, FIG. 17 also depicts ribs 502, 504 that are likewise adhesively secured to the closure 524. These tabs 58" and ribs 502, 506 can be formed integral to the closure spout 524' as depicted in cross-section in FIG. 20.

Figure 25:
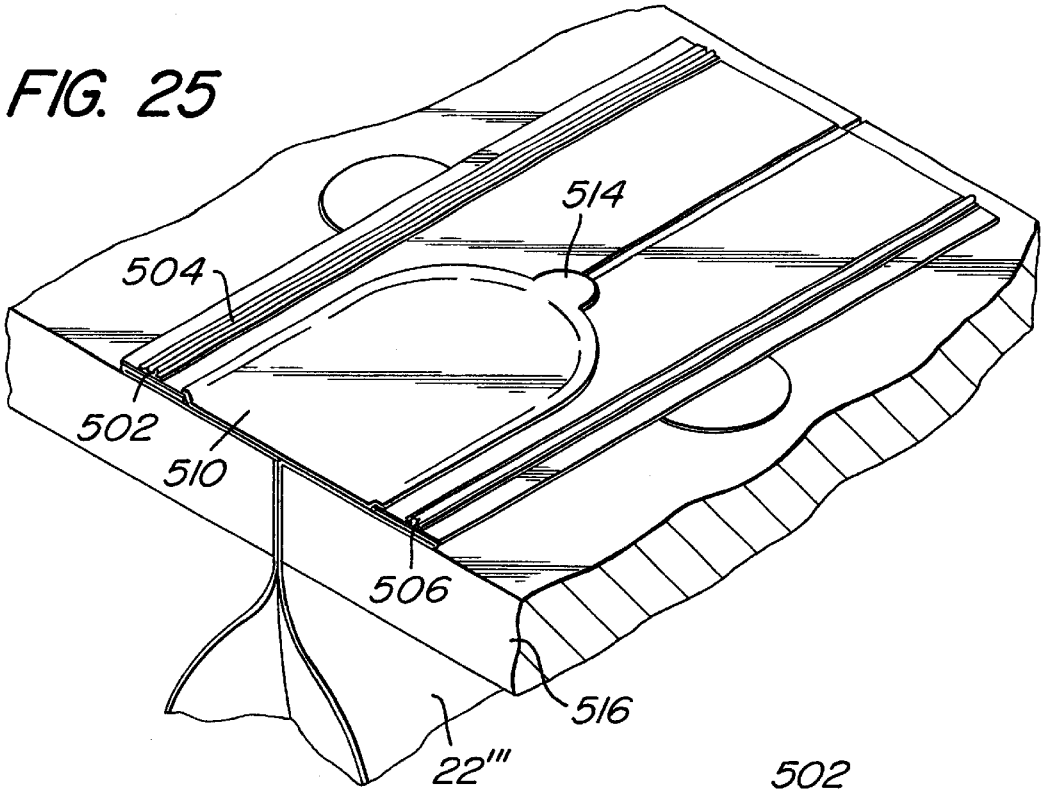
FIG. 25 is an isometric view of the top portion of the package of FIG. 16 depicted with a manufacturing jig in which the pour spout is shown in an open position for application of a label over the spout opening.

As can be seen in FIG. 25, a pre-cut piece of material, i.e. a label 510, is positioned over the U-shaped pouring spout 46 of the closure 524 and adhered thereto along its peripheral edges by means of an adhesive, or alternatively, by heat sealing. After the label 510 is applied, any excess material may be trimmed off. The label 510 may include a label pull tab 514 to assist a user in removing the label to access the contents of the bag 22'''.

As in prior embodiments, a peelable seal line (not shown) may be located at any suitable location with respect to the closure 524, e.g., just slightly below the closure 524. In any case, again, the peelable seal line extends across the width of the package 22''' and seals the inner surfaces of the abutting front and rear panels 26', 28' to each other between the inner fold lines of the gussets, respectively, while sealing the outer marginal portions of the front panel 26' to the portions of the contiguous gusseted sides and also sealing the outer marginal portions of the rear panel 28' to the portions of the contiguous gusseted sides, as is conventional. Thus, the peelable seal line serves to isolate the contents of the package from the ambient atmosphere once the package is initially filled and sealed. The pour through mouth 42 of the package 22''' is arranged to be readily opened by use of the closure 524, by grasping and pulling on the strip sections 48', 50' to pivot them from the confronting closed position shown in FIG. 23 to the open position shown in FIG. 24 and separating the package at the seal line.

Figure 21:
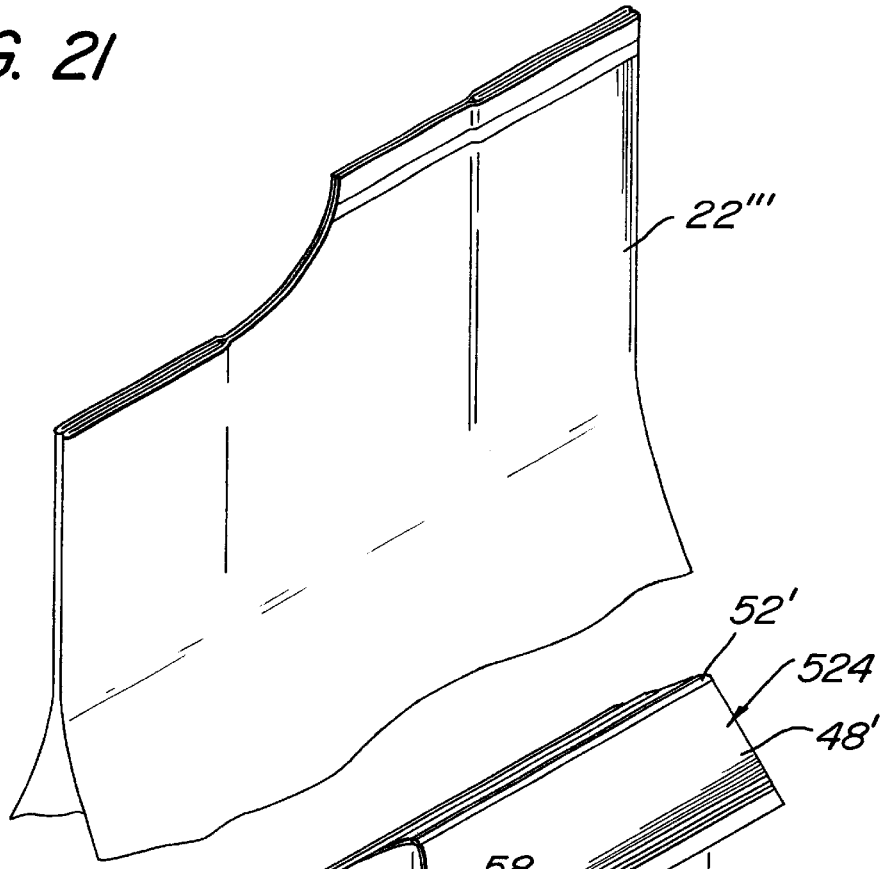
FIG. 21 is an isometric view of a gusseted bag that has been die cut in preparation for application of the pour spout of FIG. 18.
Figure 22:
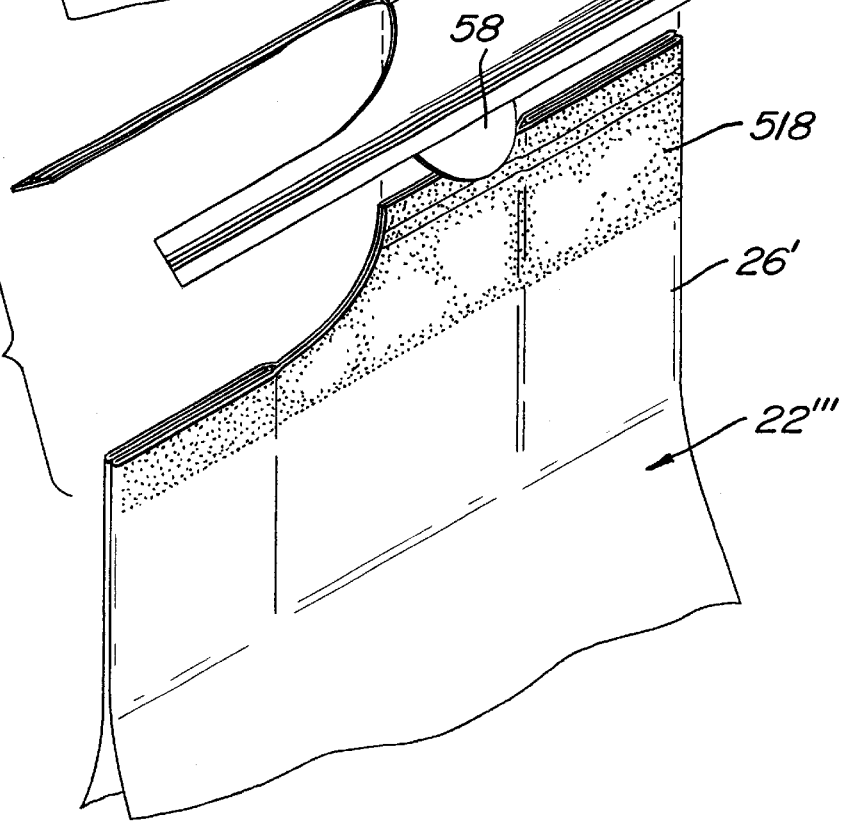
FIG. 22 is an exploded, isometric view of the top portion of the package of FIG. 16.
Figure 26:
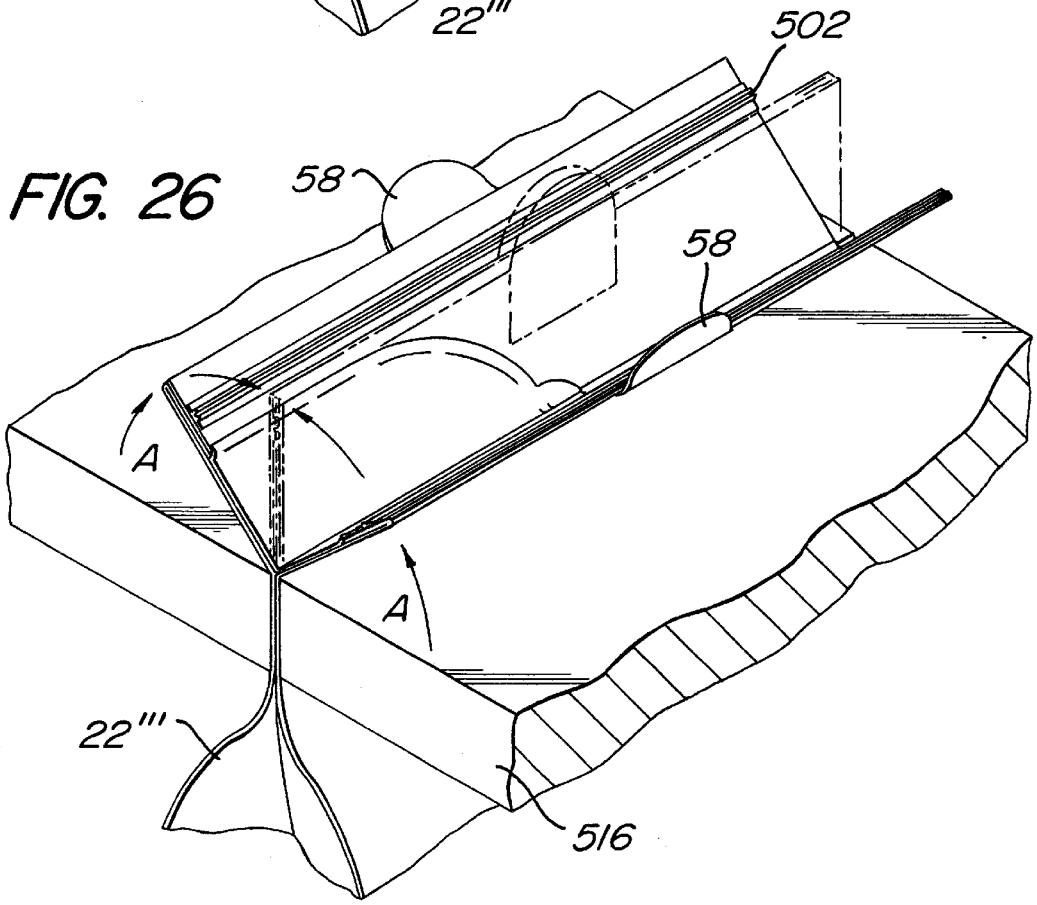
FIG. 26 is an isometric view of the top portion of the package as shown in FIG. 25 in which the pour spout is shown being folded to a closed position during installation or during closing of the pour spout.

FIGS. 21 through 26 depict a method of assembly of the embodiment of the package 500 of the subject invention. The bag 22''' is first fabricated, put into a closed position and die cut to form a spout in the gusseted bag 22''' (FIG. 21). Preferably, adhesive 518 is applied to the pour spout closure 524 or the bag 22''' itself in the area where the pour spout closure 524 is to be secured to the bag 22''' (FIGS. 22 and 23). Any means of securing as known in the art is also acceptable. The closure 524 is rotated approximately ninety degrees about hinge 52' to an open position in which the U-shaped pouring spout 46 is open to allow access to the contents of the bag 22''' (FIG. 24). This position is also the open position of the package. The peel off label 510, releasably adhesively secured to the pour spout closure 524 is then applied (FIG. 25) as described above. The pour spout closure 524 is then further rotated in directions A, as shown in FIG. 26, rotated approximately ninety degrees such that the interlocking ribs are now in position to lock together (FIG. 26). The ribs 502, 506 are then squeezed together such that rib groove 504 in rib 502 is frictionally secured to protruding track 508 in rib 506. Note that a retaining jig 516 is shown in to assist in holding the bag 22''' during the installation process.

Figure 27:
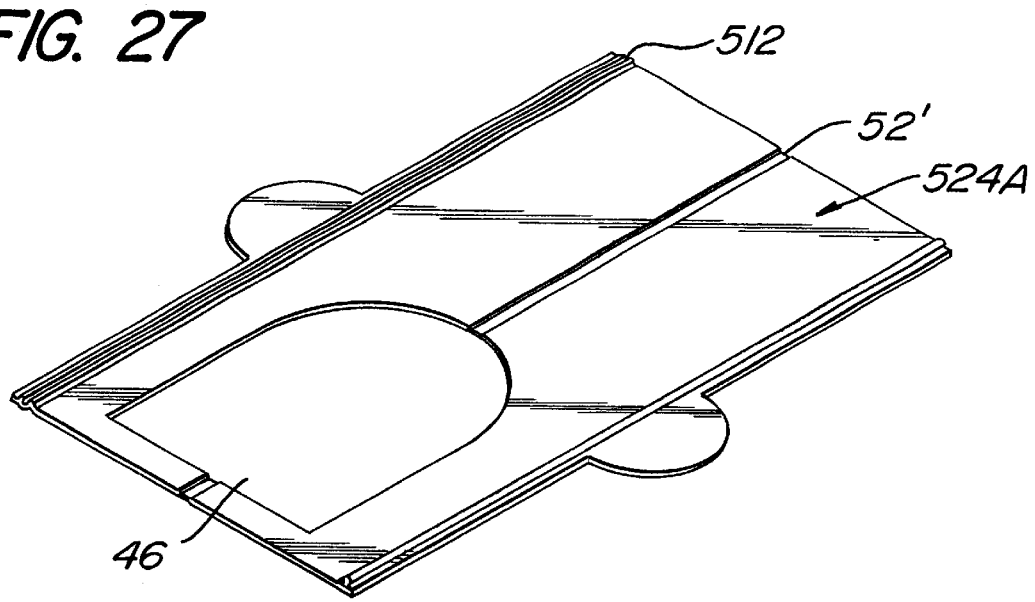
FIG. 27 is an enlarged, cross-sectional view of an alternate pour spout where the pull tabs are integrally formed with the pour spout closure.

FIG. 27 depicts an alternate closure 524A that is very similar to closure 524, but has an integral rib 512 running along the front of the closure 524 adjacent the U-shaped pouring spout 46 which adds improved strength and structural integrity to pour spout 524A of the present embodiment, particularly when the flexible package is opened.

FIG. 28 depicts another alternate closure 524B that is very similar to closure 524A, but is fabricated from a laminated film or other highly flexible material. A two part "zip-lock" style closure 530 is integral to the film, as is known in the art of household plastic bags. The reclosure 530 comprises two opposing zip-lock style extruded profiles bonded to a laminate film or other flexible material. Here, constructing the closure 524B from such a film or other flexible material facilitates automated production methods by allowing the basic closure material 524B' to be supplied in a coiled form. See FIG. 29. The closure material 524B' is then uncoiled and fed into a machine for trimming to the proper length, die cutting, and application by, for example, an adhesive, to a gusseted bag 22''''. The method of applying it to the bag would follow substantially the same basic steps as in the embodiments of FIGS. 16–27.

The nature of the preferred manufacturing method of gusseted bags (i.e. in-line trimming and die cutting on the machine) allows manufacturers to easily customize the size of the reclosure and the shape and size of the spout opening to accommodate various types and sizes of packages. Conversely, an injection molded version of this invention, for example, as shown in FIG. 27, generally must be pre-manufactured to fit a particular package style and size.

Figure 31:
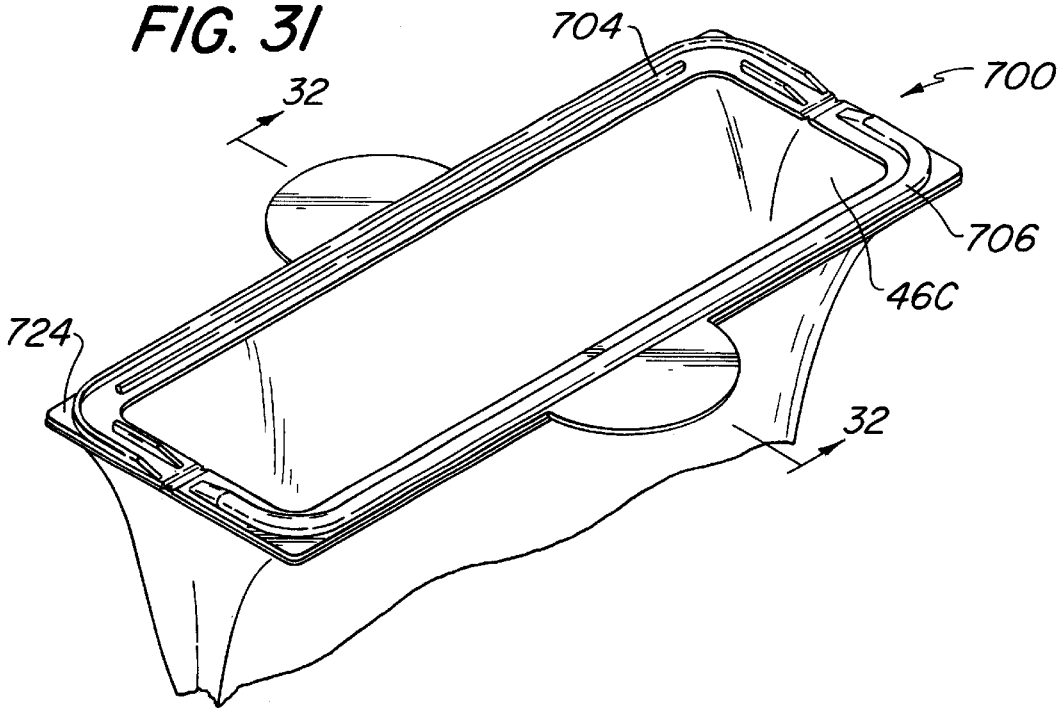
FIG. 31 is an isometric view of the top portion of still another embodiment of a flexible gusseted package including a pour-spout closure constructed in accordance with this invention and shown in an open position.

In FIGS. 30 and 31, there are shown two additional alternative embodiments of a package 600, 700 of the subject invention. The packages 600, 700 are virtually identical to the package 500 except in the details noted below. In the interest of brevity, the common structural details of the packages 500, 600 and 700 will be given the same reference numbers and their construction and operation will not be reiterated. Only the different features will be described in detail. As can be seen in FIG. 30, the pour spout closure includes a set of integral protrusions 602 extending along the outer periphery of closure strip 50" forming a groove or set of grooves 604 adapted to interlock with a second protrusion 606 extending along substantially the entire outer periphery or circumference of closure strip 48". This provides a more completely sealed perimeter than that of prior embodiments, thereby reducing moisture and atmospheric penetration. The tighter seal also aids in retaining granular products better and reduces the likelihood that fine particles will migrate out of the bag and become trapped in the center fold and/or crevices of the device.

The embodiment of FIG. 30 also depicts a pour-spout closure 624 having two orifice areas from which contents of the package 600 may be poured. On one side, there is a large spout opening 46A as is similar to the prior embodiments. However, on the opposing side of the pour spout closure, there is a spout opening consisting of a series of orifices 46B that may be used to assist in straining or metering the contents of the package 600 while pouring. The two spout openings here, 46A and 46B, allow consumers additional convenience by providing a means to remove the product from the package 600 in more than one way. Prior to use by a consumer, the pour spout closure 624 may have their spout openings 46A, 46B covered with peel off labels or other coverings similar to that shown in the embodiment of FIG. 25. These labels may include instructions for the consumer to indicate which label is desirable to peel off for a particular mode of product dispensing.

Figure 32:
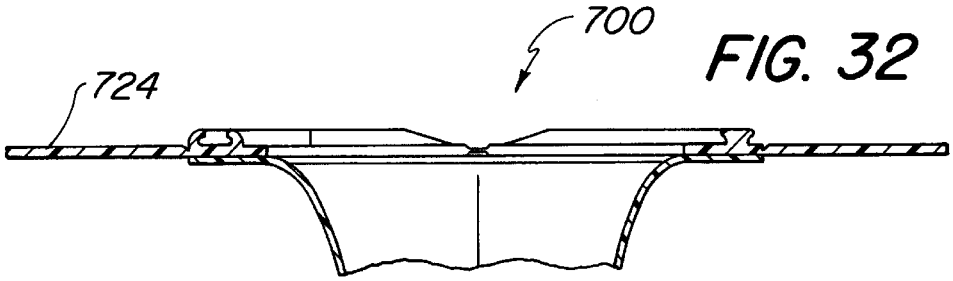
FIG. 32 is an enlarged, cross-sectional side view of the pour spout closure of FIG. 31, taken substantially along line 32—32 of FIG. 31.
Figure 33:
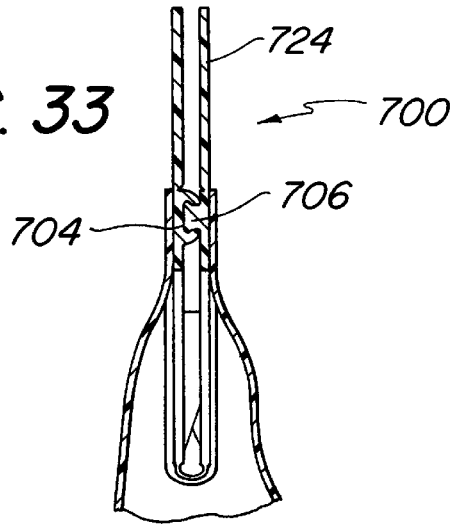
FIG. 33 is an enlarged, cross-sectional view of the pour spout closure as shown in FIG. 31, with the pour spout closure depicted in a closed position.

In FIG. 31, there is shown an optional pouring spout closure 724 having a configuration which includes a single large spout opening 46C. An advantage here is that the large spout opening 46C is provided for scooping product from the bag. Additionally, when the pour spout 624 is in the open position, the opposing hinged portions are easily bowed apart to allow greater expansion of the orifice. FIGS. 32 and 33 depict cross-sectional views of the pour spout 700 in open and closed positions respectively showing how the closure seals against itself, thereby sealing the bag.

In order to facilitate the opening and closing of any of the spout closures of this invention, each package may include some surface texture, e.g., ridges, knurls, grooves, etc., on the tabs to enhance friction when grasped between the fingers of the user of the package.

It must be pointed out that other types of interlocking members or means can be used in lieu of the interlocking posts and sockets, the catches, or the grooves and ribs described above so long as such members or means, e.g., reusable adhesive, are arranged to be releasably secured to each other. In addition, the embodiment of FIG. 16 can be adapted to utilize any of the locking means of the prior embodiments. Additionally, the pour spout openings as shown in the embodiments of FIGS. 30 and 31 may be used on any embodiment herein. It should also be clear that the spout closure may be a separate device and not an integral part of the gusseted flexible package. Thus, it is contemplated that the spout closure may be arranged to be mounted or secured on the package after the package has been initially filled, sealed and vacuumized. It should also be pointed out that packages constructed in accordance with this invention which have the pour spout closure secured thereto may utilize any type of securement means to fixedly secure them in place on their respective panels. Thus, for example, an adhesive coating or coextrusion may be utilized to secure each strip in place on its associated panel. Alternatively, the material forming the strips or only a portion of the strips may be selected so that it can be heat sealed or welded to the material making up the bag's panels. As will also be appreciated by those skilled in the art, the closures of this invention can be modified insofar as its construction and/or material composition is concerned in order to accommodate the preferred degree of opening and/or closing pressure required to operate it. Thus, it should be clear that the various the embodiments of package shown herein are merely exemplary.

Without further elaboration the foregoing will so fully illustrate our invention that others may, by applying current or future knowledge, adopt the same for use under various conditions of service.

We claim:

1. A pour-spout closure for use on a gusseted flexible package, the package being formed of a flexible material and comprising first and second panels connected to each other by respective side gussets, each of the panels having an upper end portion, said panels and said side gussets conjoin to form a pour-through mouth for the package, the pour-through mouth being openable from a closed state to an open state to enable material within the interior of the package to be poured out of the package, said pour-spout closure being arranged for closing and opening the pour-through mouth and consisting essentially of a first closure section and second closure section, said first closure section integral to said second closure section, coupled together by a living hinge, said first closure section including a first cut-away portion and arranged to be located on the first panel with said first cut-away portion being disposed over at least a portion of the pour-through mouth, said second closure section including a second cut-away portion and arranged to be located on the second panel with said second cut-away portion being disposed over at least a portion of the pour-through mouth, said first and second closure sections being elongated members extending substantially the width of the first and second panels, respectively, said first and second closure sections being arranged to be moved with respect to each other into a confronting, releasably secured relationship, whereupon a top surface of each of said first and second closure sections substantially abut one another such that said top surface of said first closure section is in contact with said top surface of said second closure section and portions of the first and second panels and the side gussets are contiguous with the pour-through mouth are positioned adjacent one another to seal said package, said first and second closure sections also being arranged to be moved into a non-confronting, non-secured relationship with each other, whereupon the pour-through mouth is opened and said first and second closure sections are separated about said living hinge such that said first and second closure sections are substantially co-planar so that the material within the package can be poured therethrough, wherein each of said elongated closure sections includes a pair of opposed side edges, a top edge, and a bottom edge, and wherein each of said cut-away portions is located adjacent to one of said opposed side edges and a contiguous portion of said top edge such that said cut-away portions form an openended spout at only one end of said pour-spout closure.

2. The pour-spout closure of claim 1 wherein said first and second closure sections are hingedly secured to each other to enable said sections to be moved from said closed state to said open state and vice versa.

3. The pour-spout closure of claim 1 wherein a bottom surface of each of said first and second closure sections is fixedly secured to the first and second panels, respectively.

4. The pour-spout closure of claim 1 wherein one of said first and second closure sections includes at least a first connector element and wherein the other of said first and second closure sections includes at least a second connector element, and wherein said at least said first and second connector elements are arranged to be releasably snap-fit together.

5. The pour-spout closure of claim 4 wherein said first connector element is a rib having a protruding member thereon and said second connector element is a rib having a receptacle groove thereon in matable relation to said rib having the protruding member.

6. The pour-spout closure of claim 5 wherein the rib having the receptacle groove extends substantially across the first closure section and the rib having the protruding member extends substantially across the second closure section.

7. The pour-spout closure of claim 4 wherein the first closure section and the second closure section each have a top surface and bottom surface, and said first connector element is located on said top surface of said first closure section and said second connector element is located on said top surface of second closure section.

8. The pour-spout closure of claim 4 wherein the first closure section and the second closure section each have a top surface and bottom surface, and said first connector element is located on said bottom surface of said first closure section and said second connector element is located on said bottom surface of second closure section.

9. The pour-spout closure of claim 1 wherein each of said closure sections includes a projecting tab portion arranged to be grasped to enable said first and second closure sections to be moved from their confronting relationship to their non-confronting relationship.

10. The pour-spout closure of claim 1 wherein said cut-away portion of said first and second closure sections includes a linear edge and an arcuate edge, said arcuate edge of said first cut-away portion being arranged to be located immediately adjacent said arcuate edge of said second cut-away portion.

11. The pour-spout closure of claim 10 wherein each of said closure sections includes a projecting tab portion arranged to be grasped to enable said first and second closure sections to be moved from their confronting relationship to their non-confronting relationship.

12. The pour-spout closure of claim 11 wherein each of said closure sections includes a pair of opposed side edges, a top edge and a bottom edge, and wherein each of said cut-away portions is located contiguous with one of said opposed side edges and a contiguous portion of said top edge, and wherein the pour-through opening is adapted to be located at the upper portion of the package contiguous with one of the side gussets.

13. The pour spout closure of claim 1 wherein said pour spout closure is molded of a plastic material.

14. The pour spout closure of claim 1, wherein said pour spout closure is fabricated from a highly flexible material.

15. The pour spout closure of claim 14, wherein the highly flexible material is adapted to be made from a material supplied in a roll form.

16. The pour spout closure of claim 5, wherein each of said closure sections includes a pair of opposed side edges, a top edge and a bottom edge, wherein the rib having the receptacle groove extends substantially along one of said pair of opposed side edges and said top edge and said bottom edge of said first closure section and the rib having the protruding member extends substantially along one of said pair of opposed side edges and said top edge and said bottom edge of said second closure section.

17. The pour-spout closure of claim 1 wherein said first cut-away portion is a plurality of holes adapted to be disposed over at least a portion of the pour-through mouth, and wherein said second cut-away portion is a plurality of holes over at least a portion of the pour-through mouth.

18. The pour spout of claim 1 wherein each of said closure sections includes a side edge, a top edge and a bottom edge, and wherein each of said cut-away portions is located contiguous with said side edge and a contiguous portion of each of said top edge and said bottom edge, wherein the pour-through opening is adapted to be located at the upper portion of the package contiguous with both of the side gussets and both of the first and second panels.

19. The pour spout closure of claim 1, wherein said pour spout closure is fabricated from a highly flexible film.

20. A pour-spout closure for use on a gusseted flexible package, the package being formed of a flexible material and comprising first and second panels connected to each other by respective side gussets, each of the panels having an upper end portion, said panels and said side gussets conjoin to form a pour-through mouth for the package, the pour-through mouth being openable from a closed state to an open state to enable material within the interior of the package to be poured out of the package, said pour-spout closure being arranged for closing and opening the pour-through mouth and comprising a first closure section and second closure section, said first closure section integral to said second closure section, coupled together by a living hinge, said first closure section including a first cut-away portion and arranged to be located on the first panel with said first cut-away portion being disposed over at least a portion of the pour-through mouth, said second closure section including a second cut-away portion and arranged to be located on the second panel with said second cut-away portion being disposed over at least a portion of the pour-through mouth, said first and second closure sections being elongated members extending substantially the width of the first and second panels, respectively, said first and second closure sections being arranged to be moved with respect to each other into a confronting, releasably secured relationship, whereupon a top surface of each of said first and second closure sections substantially abut one another such that said top surface of said first closure section is in contact with said top surface of said second closure section and portions of the first and second panels and the side gussets are contiguous with the pour-through mouth are positioned adjacent one another to seal said package, said first and second closure sections also being arranged to be moved into a non-confronting, non-secured relationship with each other, whereupon the pour-through mouth is opened and said first and second closure sections are separated about said living hinge such that said first and second closure sections are substantially co-planar so that the material within the package can be poured therethrough, wherein said first cut-away portion is a plurality of holes adapted to be disposed over at least a portion of the pour-through mouth, and wherein said second cut-away portion is a plurality of holes over at least a portion of the pour-through mouth.

* * * * *